US006584750B1

(12) United States Patent
Hanna

(10) Patent No.: US 6,584,750 B1
(45) Date of Patent: Jul. 1, 2003

(54) WALL AND METHOD OF CONSTRUCTING A WALL COMPRISING FIRST, SECOND, AND END MODULES AND A CONNECTION MEANS FOR TYING ADJOINING MODULES TOGETHER IN TENSION

(76) Inventor: George Khalil Hanna, 55 St. Kilda Road, Rivervale. Western Australia 6103. (AU)

( * ) Notice: Subject to any disclaimer, the term of this patent is extended or adjusted under 35 U.S.C. 154(b) by 0 days.

(21) Appl. No.: 09/486,135

(22) PCT Filed: Aug. 19, 1998

(86) PCT No.: PCT/AU98/00652

§ 371 (c)(1),
(2), (4) Date: May 15, 2000

(87) PCT Pub. No.: WO99/09268

PCT Pub. Date: Feb. 25, 1999

(30) Foreign Application Priority Data

| | | |
|---|---|---|
| Aug. 19, 1997 | (AU) | PO 8647 |
| Dec. 19, 1997 | (AU) | PP 1067 |
| Jun. 6, 1998 | (AU) | PP 3966 |

(51) Int. Cl.[7] ..... E04B 1/00

(52) U.S. Cl. ..... 52/745.1; 52/223.7; 52/565; 52/731.4; 52/732.3

(58) Field of Search ..... 52/582.1, 712, 52/698, 699, 582.2, 562, 223.7, 223.6, 565, 282.5, 282.4, 731.4, 732.3, 745.17, 745.1, 745.09, 745.13

(56) References Cited

U.S. PATENT DOCUMENTS

| | | | | |
|---|---|---|---|---|
| 1,553,037 A | | 9/1925 | Fritz | |
| 2,208,589 A | * | 7/1940 | Leemhuis | 52/582.1 |
| 3,862,737 A | * | 1/1975 | Fuston, Jr. | 249/196 |
| 5,309,686 A | * | 5/1994 | Underwood et al. | 52/29 |
| 5,368,416 A | * | 11/1994 | Cataldo | 405/285 |
| 5,706,620 A | * | 1/1998 | DeZen | 52/220.2 |

FOREIGN PATENT DOCUMENTS

| | | | | |
|---|---|---|---|---|
| CH | 568451 | * | 4/1973 | 52/582.1 |
| CH | 568451 | | 10/1975 | |
| GB | 2111633 | | 7/1983 | |

* cited by examiner

*Primary Examiner*—Carl D. Friedman
*Assistant Examiner*—Naoko Slack
(74) *Attorney, Agent, or Firm*—Dorsey & Whitney LLP

(57) ABSTRACT

Disclosed is a method of construction of a wall (40) from first, second and end modules (10, 20, 30) each forming part of the wall. The method includes assembly of two modules being first, end or first and end modules (10, 30) having portions forming part of the wall (40) by aligning these modules (10) in a desired alignment and connecting them together with connection means (50) to form a supporting structure (200) for second modules (20). The connection means (50) has a tie portion (51) generally extending in the direction of the alignment. The tie portion (51) has a portion corresponding with connection portions (26) of a second module (20) and cooperation of the corresponding tie portion (58), extending between guides (56) formed as part of the tie portion (51), with the connection portions (26) connects the second module (20) to the supporting structure (200). In such manner, a portion of a wall (40) may be constructed. Use of mortar of scaffolding and concrete pouring techniques may thus be avoided in construction of a structure.

33 Claims, 31 Drawing Sheets hanger units
wall construction
hanger units
hanger units
190
150
56
20a
56
112
85
41a
20
120b
156
156
89a
112
88
140a
56
140
20
24
13
56
10
56
140
10
57
85
113
110
72
111
89a
111
113
110
89
141
40
50a
56
85
120
131
125
85
127
130
85
100
89
85
50
50a
56

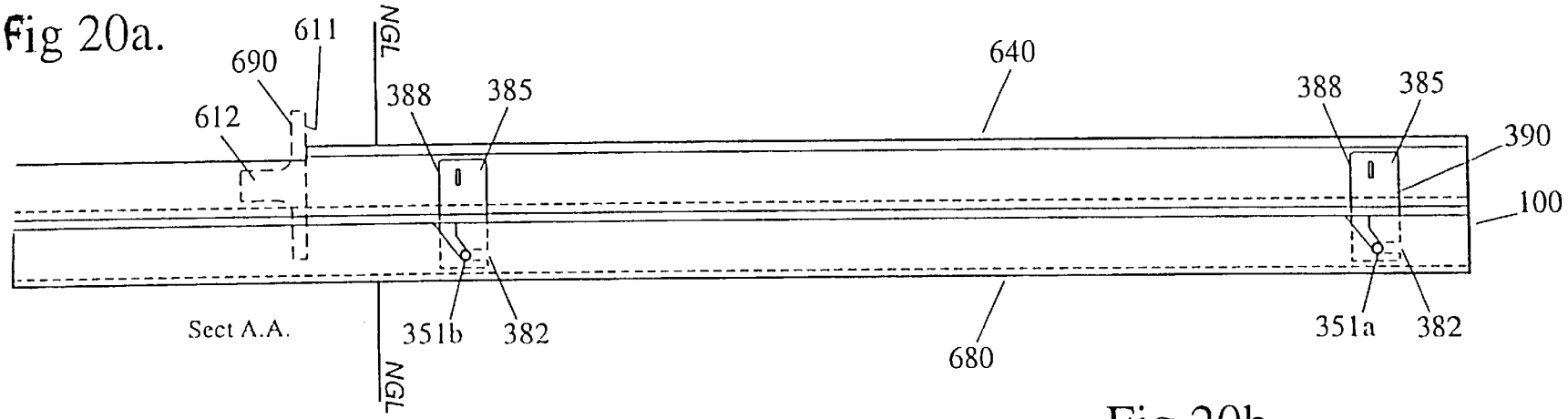
Fig 20a.
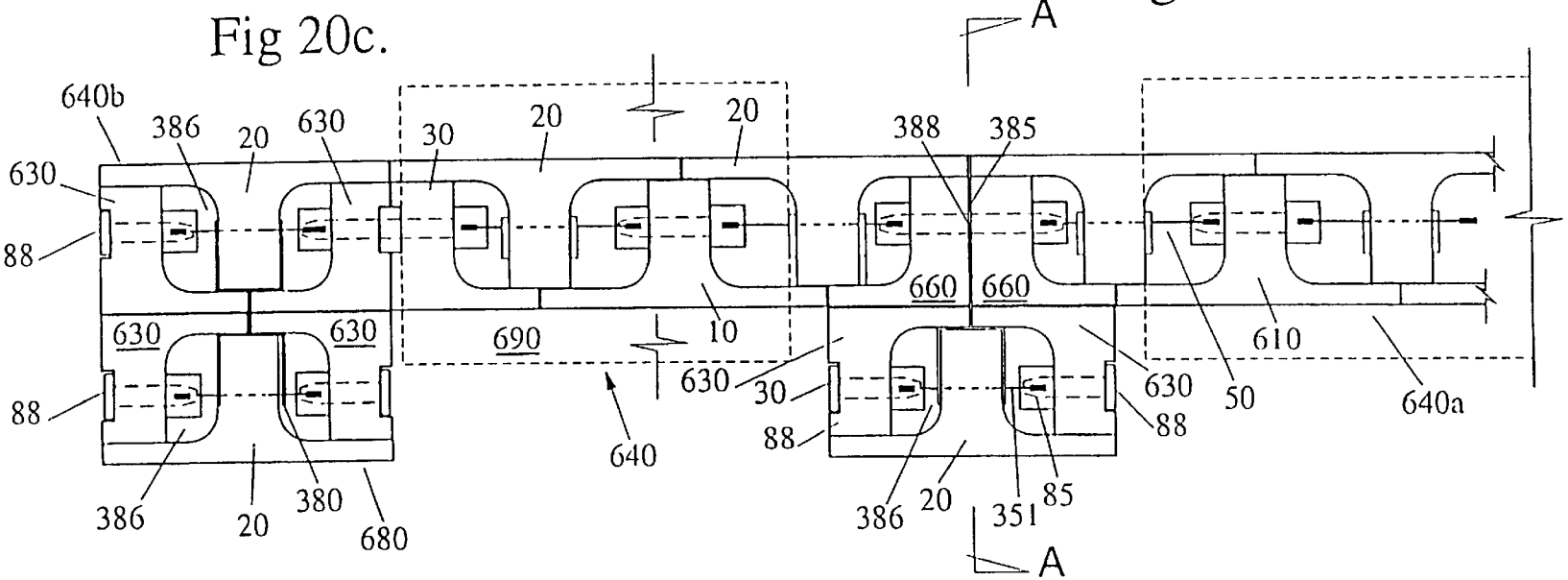
Fig 20b.
Fig 20c.

387
382
R 387
380
390
386
387

382
R
382
380
390

382
387
382
387
382
380
386
390
386
382 top
bottom
820
A
B
D 817
810

540

580 inside
outside
800
window
820
810

830

WALL AND METHOD OF CONSTRUCTING A WALL COMPRISING FIRST, SECOND, AND END MODULES AND A CONNECTION MEANS FOR TYING ADJOINING MODULES TOGETHER IN TENSION

This application claims the priority of PCT/AU98/00652, filed Aug. 19, 1998, which in turn claims the priority of Australian patent application numbers PO8647 filed Aug. 19, 1997, PP1067 filed Dec. 19, 1997, and PP3966 filed Jun. 9, 1998, all of which are incorporated herein by reference.

1. Field of the Invention

This invention relates to a system or method for the modular construction of walls of the type used in the building industry generally and in the housing industry in particular. The system or method is suitable for construction of both load and non-load bearing walls. The system is called the STRONGWALL™ construction system.

2. Background to the Invention

Structural walls, as generally used in the building and housing industries, fall into one of the following categories, being blockwork construction; in situ concrete, or similar curing material; prefabricated panels, requiring a secondary process, such as post-tensioning, or on site bolting.

Brickwork or blockwork wall construction requires the slow, labour intensive process of mortaring each joint, maintaining strict discipline to, horizontal and vertical alignments and requires scaffolding for lifts greater than 1.8 metres, increasing cost and slowing construction. This category is greatly affected by the weather.

Clad framework is also labour intensive whether the framework is fabricated from steel, timber or other material. Modern construction tools, fasteners and equipment needs to be employed. It is also greatly affected by weather conditions.

In situ concrete wall construction is similarly labour intensive, requiring teams to construct formwork, place reinforcement erect scaffolding, propping and shoring; and then pour the concrete. The forming, placing and curing time create extra costs and lengthy construction time. Any errors in the process necessitate expensive remedies and long delays and, again, the process is greatly affected by weather conditions.

Prefabricated panels relieve many of the problems associated with the previous methods, by substantially reducing time on site, and confining much of the labor intensive work of fabrication to an efficient factory environment. However, to make such a system cost effective, the panels need to be of such a scale that cranes are required in the factory and on site to move and place the panels, and methods of connection and alignment become secondary processes that add to the cost of construction.

In each of the prior art methods of construction, a high degree of direct supervision and/or a highly skilled work force is required to efficiently and safely construct a wall of acceptable quality and standard.

SUMMARY OF THE INVENTION

It is the object of the present invention to provide a fast and economical system or method of construction of a wall that reduces the dependency on. skilled labour; cranes; modern construction tools and fasteners; and scaffolding for the construction of load bearing and non-load bearing walls.

With this object in view, the present invention provides, in a first aspect, a method of construction of a wall from first, second and end modules each having a portion forming part of the wall including:

aligning a first or end module and one of: a first and an end module in a desired alignment;

connecting the two modules together with at least one connection means, having a tie portion generally extending in the direction of the alignment, to form a supporting structure for at least one second module;

connecting a second module to the supporting structure by cooperation of a connection portion of the second module with a corresponding connection portion of said supporting structure to form at least a portion of the wall.

In this form of the invention, first and end modules may be called supporting modules.

In a preferred embodiment of the invention, the connection portion of the second module cooperatively engages with a corresponding portion of the tie portion of the connection means. Such engagement allows connection of the second module to the supporting structure forming part of the wall and may allow, during construction, the second module to be temporarily hung from the supporting structure, which may be called a hanger unit.

The connection means may be provided with one or a number of guide means for locating the second module in a desired space relation to the supporting structure. The guide means are positioned appropriately relative to the tie portion to achieve this objective. The guide means may form part of the tie portions with the corresponding tie portions extending between them.

The first, end or first and end modules may be connected together by a plurality of connection means spaced along vertical lengths of the adjoining modules providing a plurality of corresponding different tie portions for engaging cooperation with plural connection portions of the second module allowing connection to the supporting structure. The connection means may be the same or different, for example connection means connecting first modules may be different in length than those connecting end modules; or first and end modules. Length may be dictated by flange length of adjoining modules. At least two such connection means may be used to connect adjoining modules therefore providing at least two corresponding tie portions for engagement with two second module connection portions. A greater number than two may be used as necessary.

The second modules may have a T-section with a flange portion and a vertically extending web portion provided with at least two connection portions. In this case, the corresponding tie portions may have length substantially equal the width of the web of the second module. First modules may also have a T-section with a flange portion and a web portion and may be assembled from L-shaped or other sub-first modules, for example half modules, where desired. On connection, the vertically extending web portions of second modules extend between the guide means of the connection means.

In a particularly preferred aspect of the invention, bevelled slots or cuts may be employed as second module connection portions which, during construction, engage with rods forming at least two corresponding tie portions of said connection means for connection of second modules to the supporting structure. This should enable secure connection between the second module and the supporting structure but use of further fastening is not precluded.

The wall may include a number of end modules defining the start and end of the wall. End modules may have an L-section rather than a T-section preferred for the first and second modules and may be similar to a half section. The same wall may also have one or more starts and ends along its length. At each start and end an end module may be connected with connection means, as described above, to a first module. End modules may be connected together to form supporting structures for second modules, notably at piers in a piered wall construction.

End modules may also define openings in a wall such as doors and windows. For these cases and also in the case of the same wall abutting another wall (for example, at right angle to it) the end modules may be connected by connection means to a door or window frame or similar fitting or to another wall. Connection means may be hook bracket assemblies with co-operating portions fixed to the door or window frame and end modules at each side of the door or window frame and fixed to the end module and the abutting wall. Hook bracket assemblies on either side of the door or window frame are advantageously in inverted relation to each other to facilitate construction.

In analogous manner, internal walls or partitions may be connected to other walls or partitions of the structure with hook bracket assemblies. Thus a first wall or partition may be connected to a second wall or partition by hook bracket assemblies having first cooperating portions connected to the first wall or partition along a line of desired connection and second cooperating portions connected along a vertical length of one end of the second wall or partition such that on cooperation, connection is made. Two or three such hook bracket assemblies are generally suitable to connect one wall or partition to another.

The modules of the supporting structure, that is the first modules, end modules or the first and end modules, may be aligned in a desired alignment of the wall. For example, at a corner, two first modules may be aligned at the angle of the corner and, depending on whether an internal or external corner is to be formed, a suitably angled key or tie rod may be employed to assist in their connection. If a right angle corner is required, the two first modules are aligned at right angles such that they may be connected together. Two such modules may be connected with the assistance of a corner tie rod with two sets of guides such that on connection, the modules form a supporting structure for two second modules to complete, for example, an external corner. The first modules may form part of adjoining supporting structures. The first or second modules may have flanges or webs shortened or otherwise modified to suit the corner, particularly where an angled corner is required.

A comer, for example an internal corner, may be constructed by aligning modules of adjoining supporting structures at the angle of the corner and connecting these with the assistance of a key or tie portion angled to suit the angle of the corner. So, at a right angle corner, the corner key or corner tie rod may be shaped as a right angle.

A capping member may be used at the top or bottom of a portion of the wall for further connection of modules comprising the wall portion and distribution of horizontal and vertical forces along the wall. The capping member may be plain or a castellated member provided with cleats for connection to structural members supported on top of the wall.

In a further aspect of the invention, there is provided a kit comprising first modules, second modules, end modules, module connection means, capping members, doorframes, window frames and windows to fit the frames, and door and window connection means for use in accordance with the method of the present invention.

In a still further aspect of the invention, there is provided a structure including a wall constructed in accordance with the method of the present invention.

It will be understood that the method is not restricted to the construction of walls; and wall-like structures such as fences, partitions, piers, columns and so on may be suitably constructed with the method of the invention. Thus the term "wall" is intended herein to be compendious description of all such structures.

A piered wall may be constructed in accordance with the methods above described. In this case, the wall has at least one pier along its length including at least two end modules or a first and an end module being pier modules connected together by first connection means to form a supporting structure for a second module of the pier. The supporting structure is connected to the remainder of the wall by a bracket having first means for engaging connection means connecting two modules forming part of the remainder of the wall together; and second means for engaging first connection means connecting the at least two pier modules together. On engagement of the first and second engagement means with the connection means the pier is connected to the remainder of the wall. Engagement may be made with tie or key portions of the connection means as appropriate. The bracket may connect with tie and key portions of the first. connection means and connection means respectively, or vice versa.

In one further aspect of the invention the method is used for construction of a structural column comprising assembly and connection of second modules having a flange and a web with angled slots formed proximate the ends of said second module webs wherein webs of two second modules are aligned in opposition with slots facing downwards; downward facing cleats of a connection means are engaged with the slots at top and bottom of the webs to form a supporting structure comprised of said second modules and connection bracket; and angled slots of two further second modules facing upward are engaged with upward facing cleats of said connection means at top and bottom of said further second modules to form the column.

The column connection means may be a bracket having a body of rectangular section, two opposed sides of said section being connected to cleats being angled upward from a horizontal medial axis of said section and the remaining two opposed sides of said section being connected to cleats angled downward from the horizontal medial axis of the connection means. The cleats comprise plate portions for engaging angled slots of second modules having flange and web and formed in the web and upstanding walls defining two edges of said plate portions. These walls are provided to make engagement secure. Engagement of the cleats with the angled slots of the second modules allows construction of a column.

The connection means may be a structural member extending substantially the length of the column. The column may be formed with upper and lower cleats angled upward to engage with angled slots of the second modules. A footing may be provided for the column.

The present invention may provide advantages in reducing the need for skilled labour, scaffolding, modern tools and fasteners in the construction of structures. Indeed, need for these may be eliminated in accordance with the present invention.

DESCRIPTION OF THE DRAWINGS

The invention may be more fully understood from the following description of preferred embodiments thereof made with reference to the accompanying drawings in which:

FIG. 20*a* shows a plan view detail of the fence wall shown in FIG. 19*a;*

FIG. 20*b* shows a cross section view along line A—A of FIG. 19*a*, 19*b* and 20*a;*

FIG. 20*c* shows an end pier of the fence wall shown in FIGS. 19*a*, 19*b* and 20*a;*

DETAILED DESCRIPTION OF THE PREFERRED EMBODIMENTS

The method of the invention includes the assembly of various modular components. Therefore, description is first provided of the first, second and end modules; the connection or tie means used for connecting the first and end modules; or first and first modules thus providing a supporting structure for the second modules.

1. The Modules

Figure 1A:
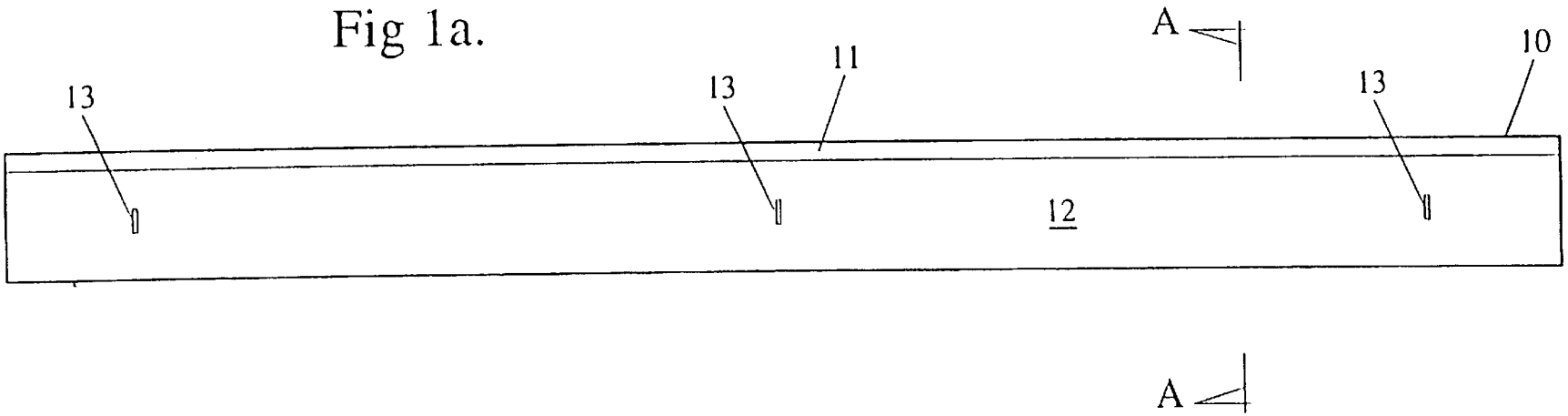
FIG. 1*a* shows a side view of one example of a first module of the present invention used in a first preferred embodiment of the invention.
Figure 1B:
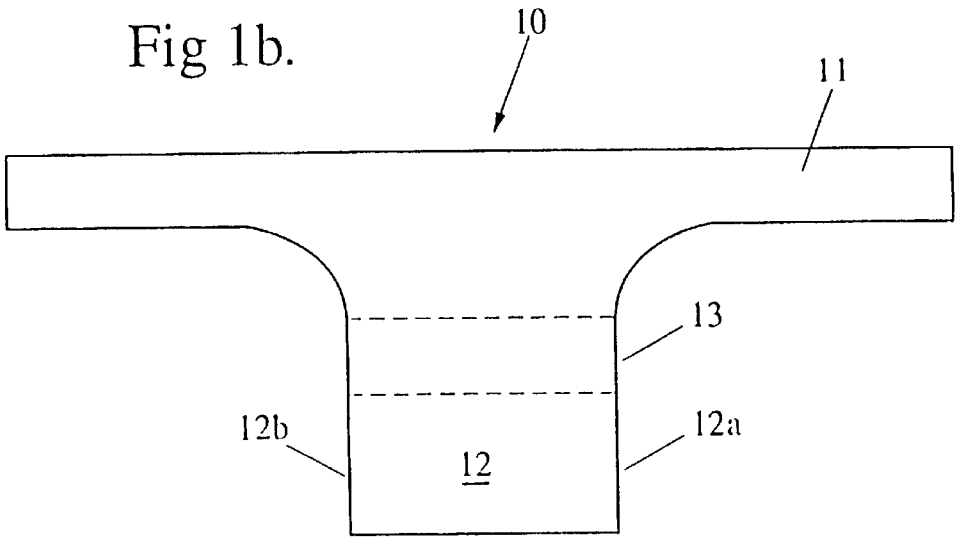
FIG. 1*b* shows a cross-section view along section line A—A of FIG. 1*a;*
Figure 2A:
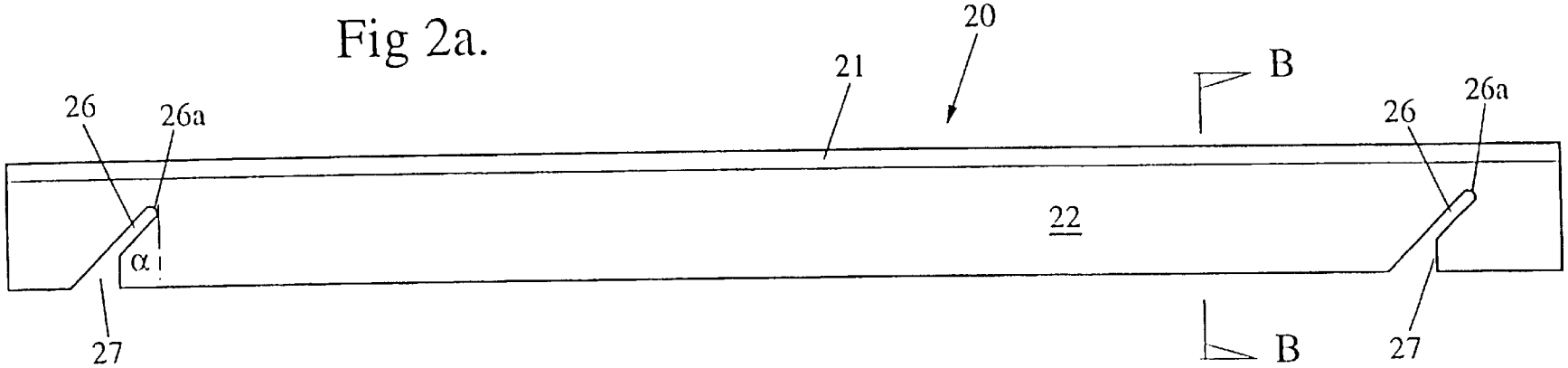
FIG. 2*a* shows a side view of one example of a second module used in a first preferred embodiment of the invention.
Figure 2B:
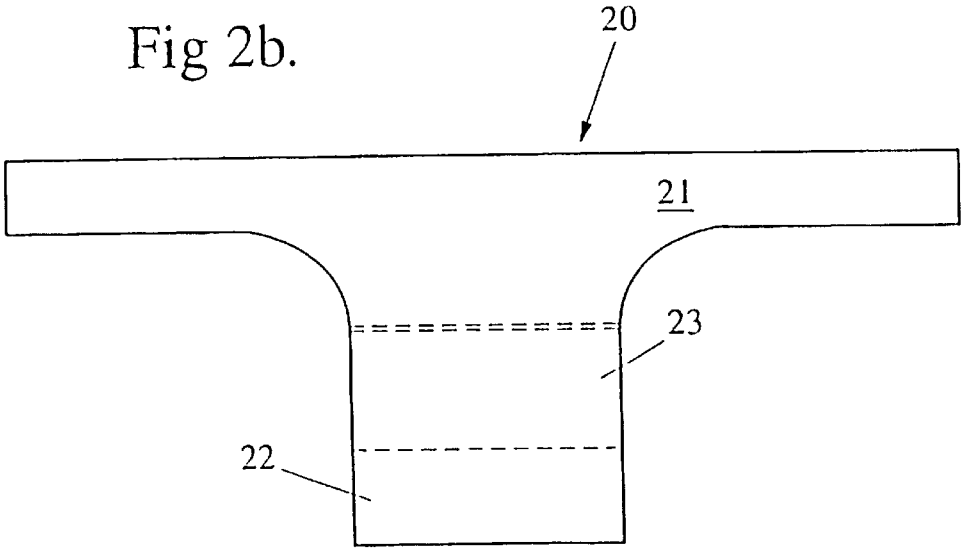
FIG. 2*b* shows a cross section view along section line B—B of FIG. 2*a;*
Figure 4A:
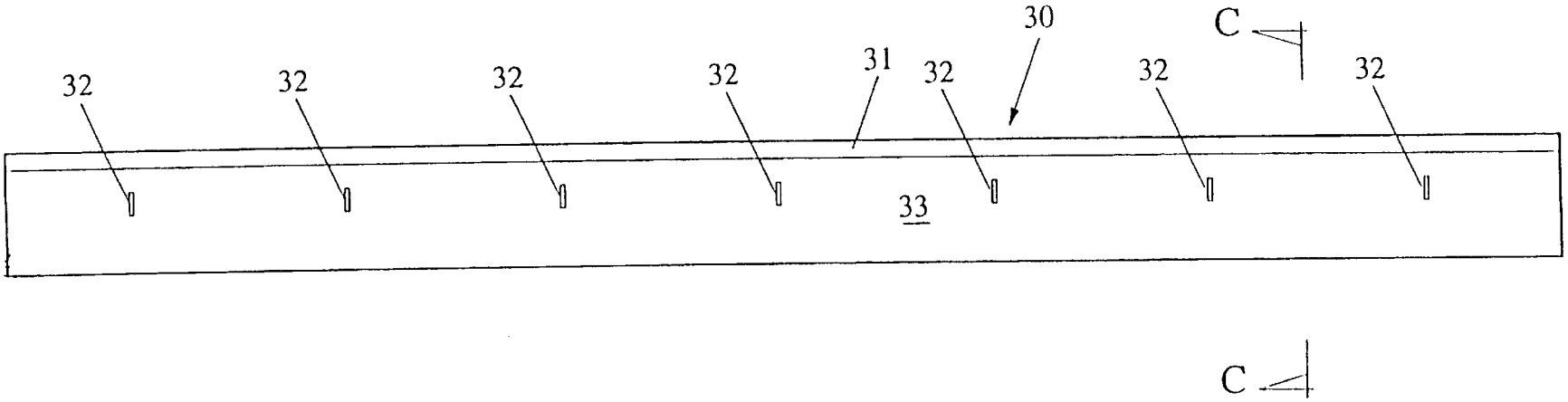
FIG. 4*a* shows a side view of one example of an end module used in a first preferred embodiment of the invention.
Figure 4B:
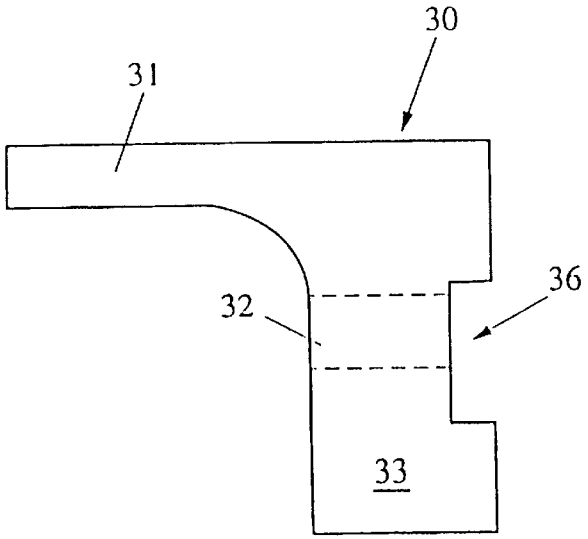
FIG. 4*b* shows a cross section view along section line C—C of FIG. 4*a;*

In a first preferred embodiment of this invention, the first and second modules 10 and 20 are plain T-Cross section panels as shown in FIGS. 1 and 2. There are also provided Half T- Cross section end modules 30 in the form of panels, (or L-Cross section panels) as shown in FIG. 4. The length of these modules is generally the full height of the wall to be constructed and the widths and thicknesses of the cross sections of the same modules depend on the design of the same wall. However, an alternative construction may be envisaged in which the modules are sized only to form a portion of the height of the wall, for example above or below windows or doors.

In yet another form of this invention the first, second and end modules could be made from fibre reinforced concrete, from metal, from timber or from any other suitable material. They also could be made of composite construction whereby the flange of the T-section and the Half T-Section (L-Section) is made from one material and the web from another, e.g. concrete flange with metal web or vice versa. Fibre reinforced concrete or cement flange with metal web or vice versa. Timber flange with metal web or vice versa and so on. In all such cases the web of each module is provided with suitable anchorage to fit the connection means, modified if required, as necessary to connect the modules together to form the wall in accordance with the method of the invention.

Figure 13A:
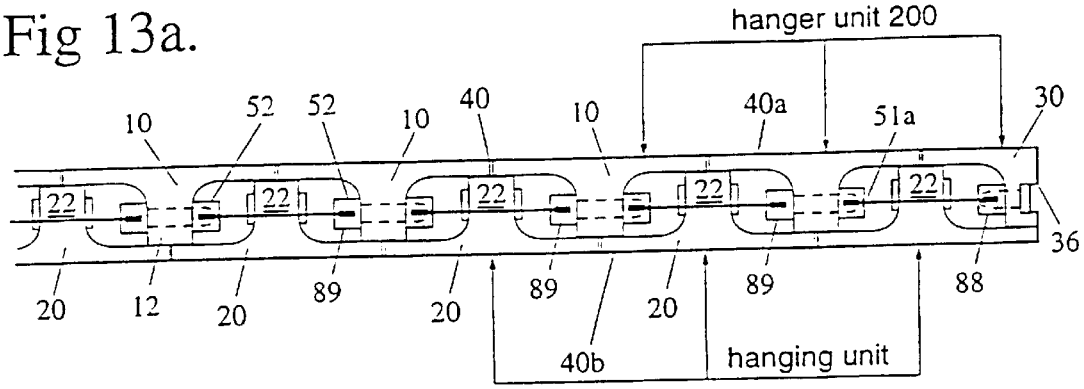
FIG. 13*a* shows a plan view of one example of a wall assembled in accordance with one embodiment of the method of the invention.
Figure 13B:
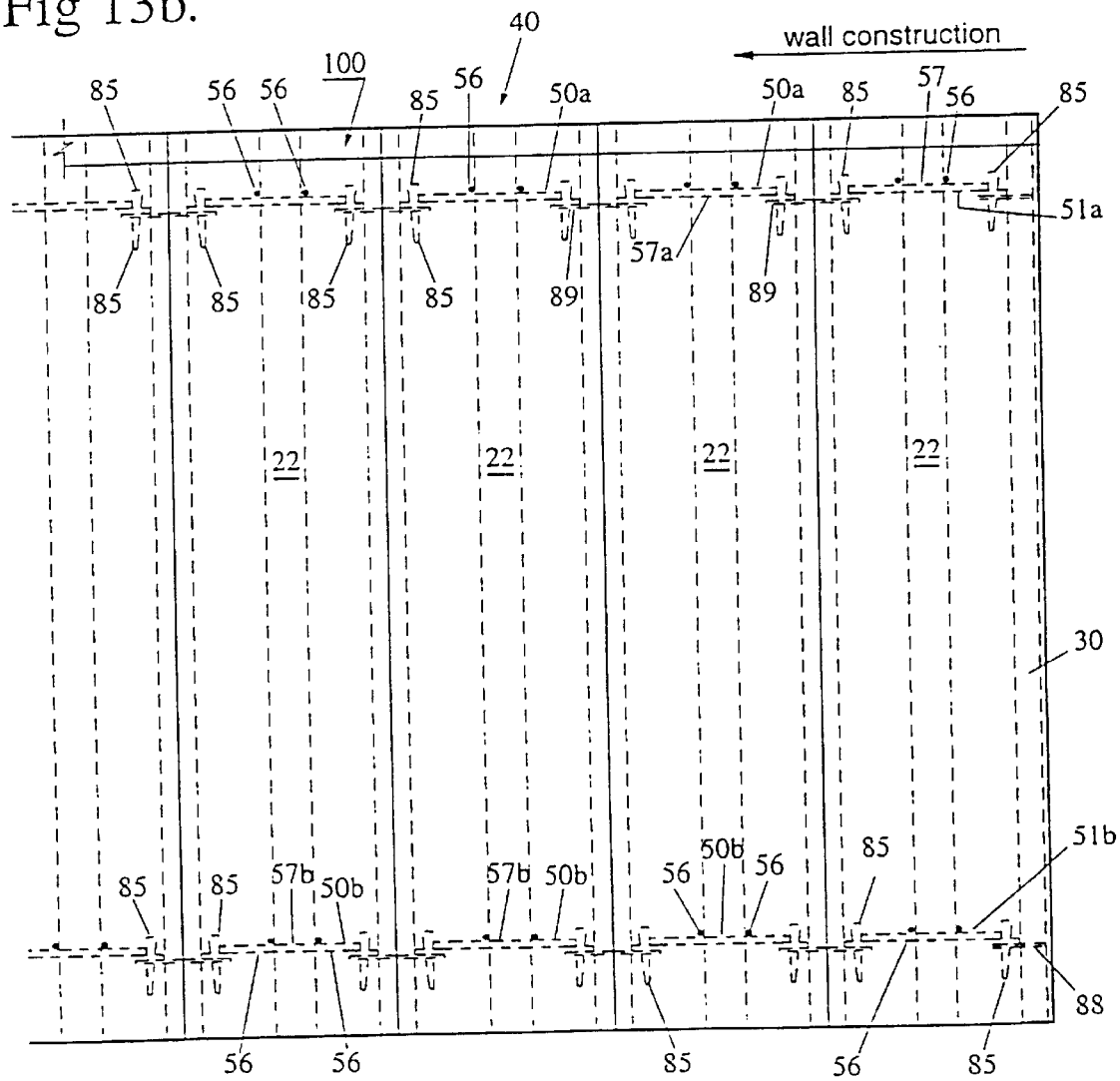
FIG. 13*b* shows an elevation of the wall shown in FIG. 13*a;*

As shown more clearly in FIGS. 13*a* and 13*b* which show the assembled wall 40, first and end modules 10 and 30 form one face 40*a* of the wall 40 being constructed. Second modules 20 form the other face 40*b* of the same wall 40. This may be an outer face of the wall 40 where such is an external wall. For an internal wall, the first and second modules 10 and 20 may be used for either face of the wall 40.

Figure 29:
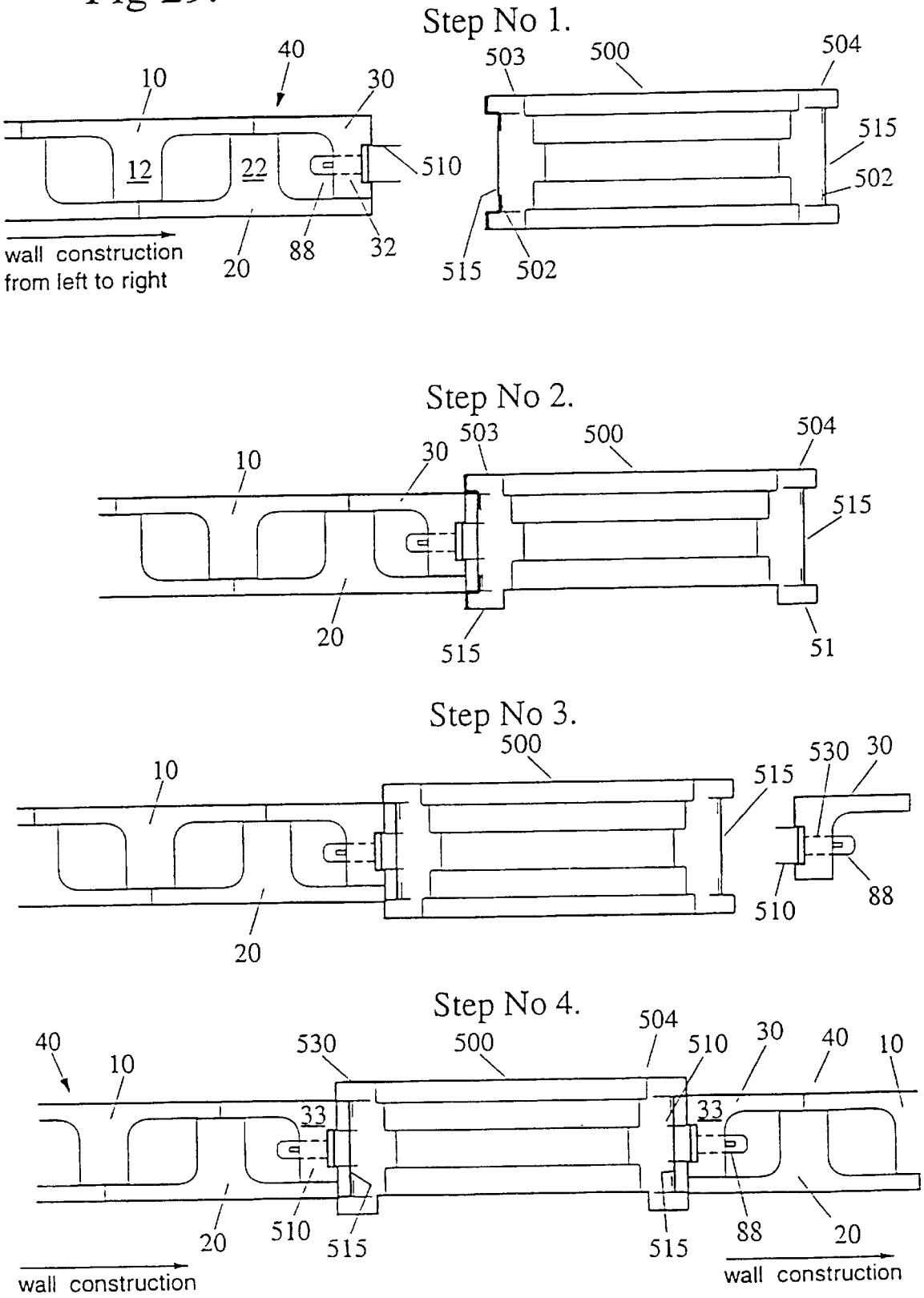
FIG. 29 shows one example of assembly stages for a door or window assembled in accordance with one preferred embodiment of the invention.
Figures 30A, 30B, 30C, 30D, 30E, 30F:
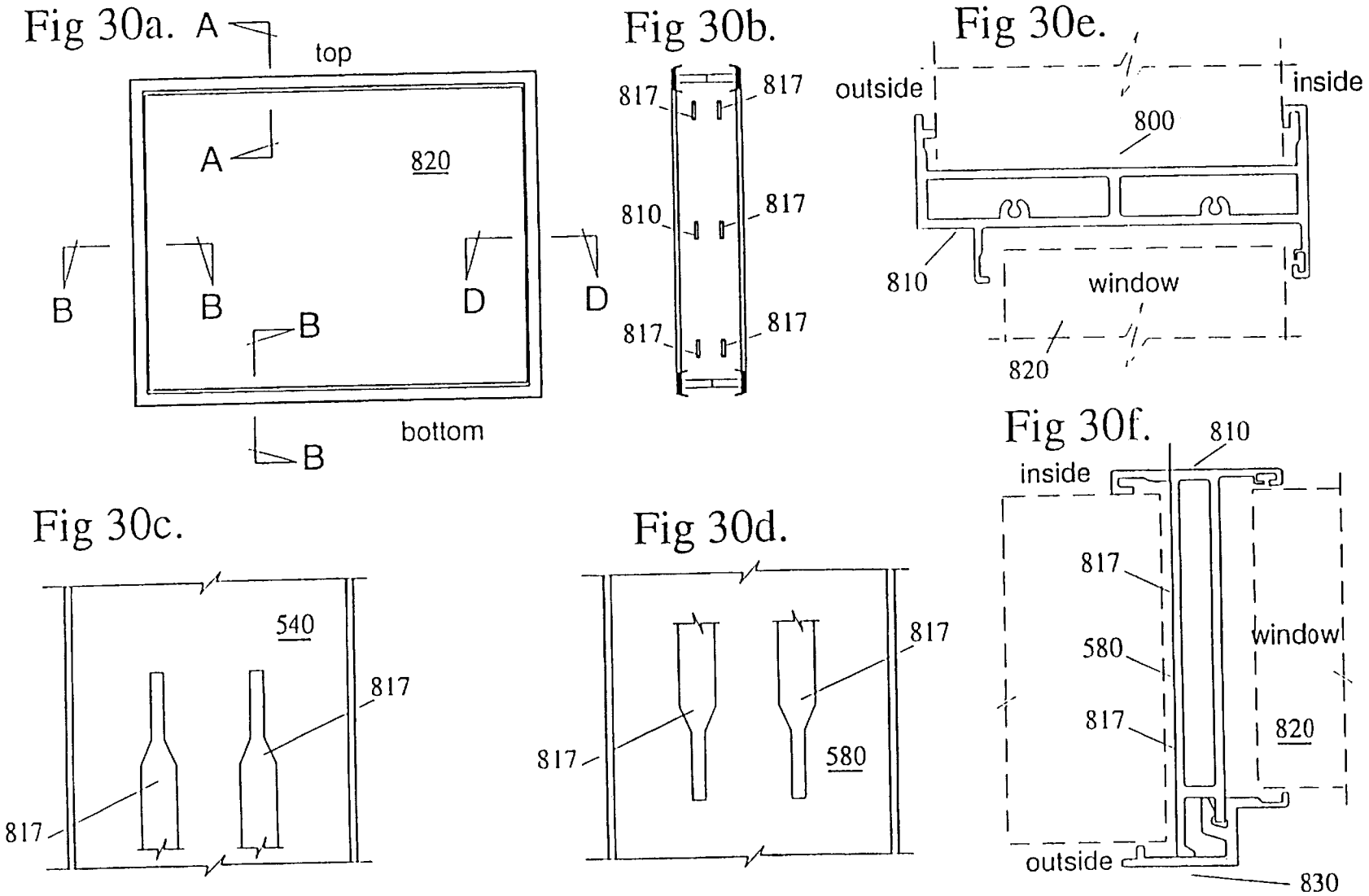
FIG. 30*a* shows a front elevation of one example of a window frame for use in accordance with the method of the invention.
FIG. 30*b* shows a side elevation of the window frame of FIG. 30*a;*
FIG. 30*c* shows a view of one side of the window frame of FIGS. 30*a* and 30*b;*
FIG. 30*d* shows a view of the opposite side of the window frame of FIGS. 19*a* to 19*c;*
FIG. 30*e* shows a cross section view of the window frame along section line A—A of FIG. 30*a;*
FIG. 30*f* shows a cross section view of the window frame along section line B—B of FIG. 30*a*.
Figure 31B:
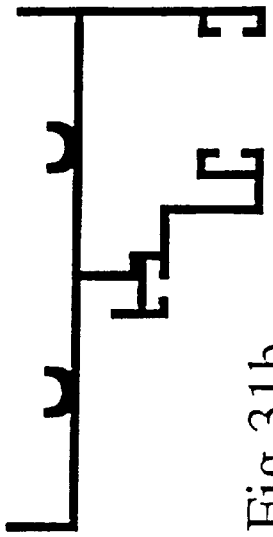
FIG. 31*b* shows a section of the window frame along section line A—A of FIG. 31*a;*
Figure 31C:
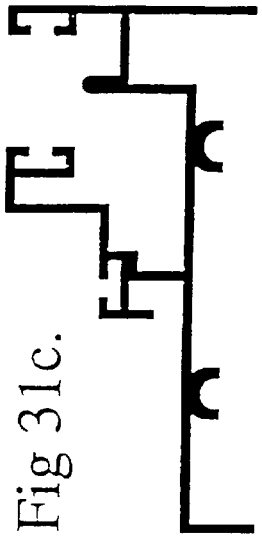
FIG. 31*c* shows a section of the window frame along section line B—B of FIG. 31*a;*
Figure 31D:
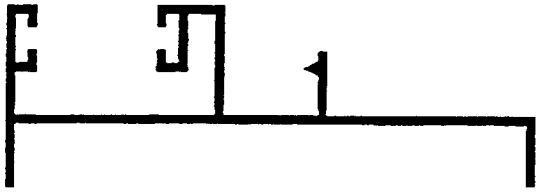
FIG. 31*d* shows a section of the window frame along section line C—C of FIG. 31*a*.
Figure 31A:
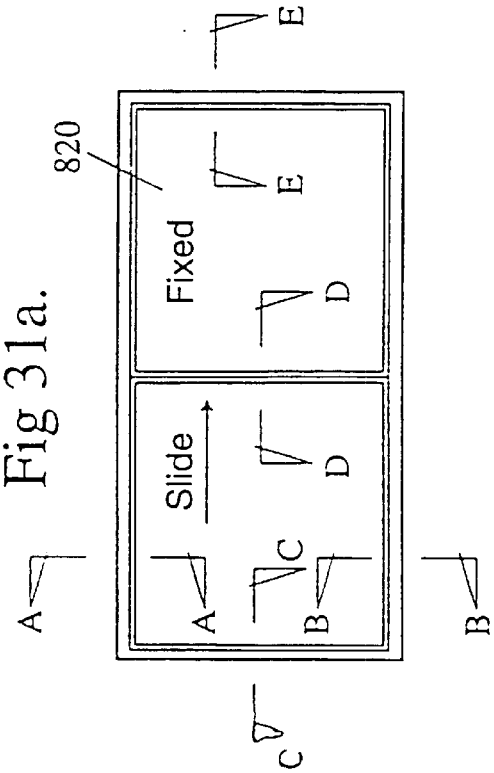
FIG. 31*a* shows an elevation of one example of a window for use in accordance with the method of the present invention.
Figure 31E:
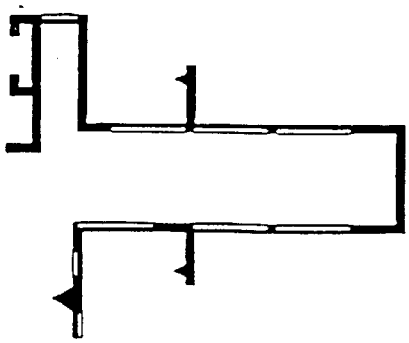
FIG. 31*e* shows a section of the window frame along section line D—D of FIG. 31*a.*

End modules 30 are generally used at each end of the wall 40 and also on each side of any opening provided in the same wall, for example, on each side of a door frame or window frame as shown in FIG. 29. They may be used elsewhere along the wall and may define sides of a wet joint in the same wall. A wet joint is a vertical joint which may be provided anywhere along the length of the wall and which may be filled with cement and sand mortar, wall plaster or other suitable materials finished flush with both faces of the wall to complete the wall. Wet joints are introduced along the length of a wall to compensate for any shortfall in the given lengths of a wall which does not correspond to a full or end module.

First, second and end modules 10, 20 and 30 may be used to form a pier or a column or may be cut into shorter lengths to be used, as a fence wall or above and below any openings provided in the same wall 40, in the same manner as full-length units. Also, first and second modules 10 and 20, modified as necessary, are used to form external and internal corners in walls meeting at right angles and at different angles and of the required length. In these cases, the modules may be moulded or cut with web and flange at the required angles. For example, the webs or flanges may have an edge extending at a desired angle to the plane formed by the panel portion of the modules. Flanges of first and second modules may be moulded smaller when used at right angle corners.

All modules are advantageously lightweight in construction allowing convenient handling by one or two people.

As all modules have same or similar cross-section, they may be produced from a single mould or single mould modified to suit. The cross-section described may be varied from the T-cross section provided that the modules may still be employed in accordance with the method of the invention.

The First Module

Referring more particularly to the first module 10, as shown in FIG. 1, this module is a plain concrete T-shaped cross section panel. The length of the panel is equal to the full height of the wall being constructed. The widths, and thickness of the flange and web of the panel and the overall thickness of the panel depend on the design of the same wall.

The web 12 of this first module 10 is provided, at locations along its length with small rectangular holes 13, which pass through from one face 12*a* of the web 12 to the other face 12*b*. These rectangular holes 13 extend perpendicularly to the longitudinal axis of the first module 10. The number and location of these holes 13 depends on the height of the wall being constructed and on the design loads acting on the same wall. At least two such holes 13 are required per module and locations proximate the top and bottom of the web 12 are suitable bearing in mind expected design loadings.

Figure 7A:
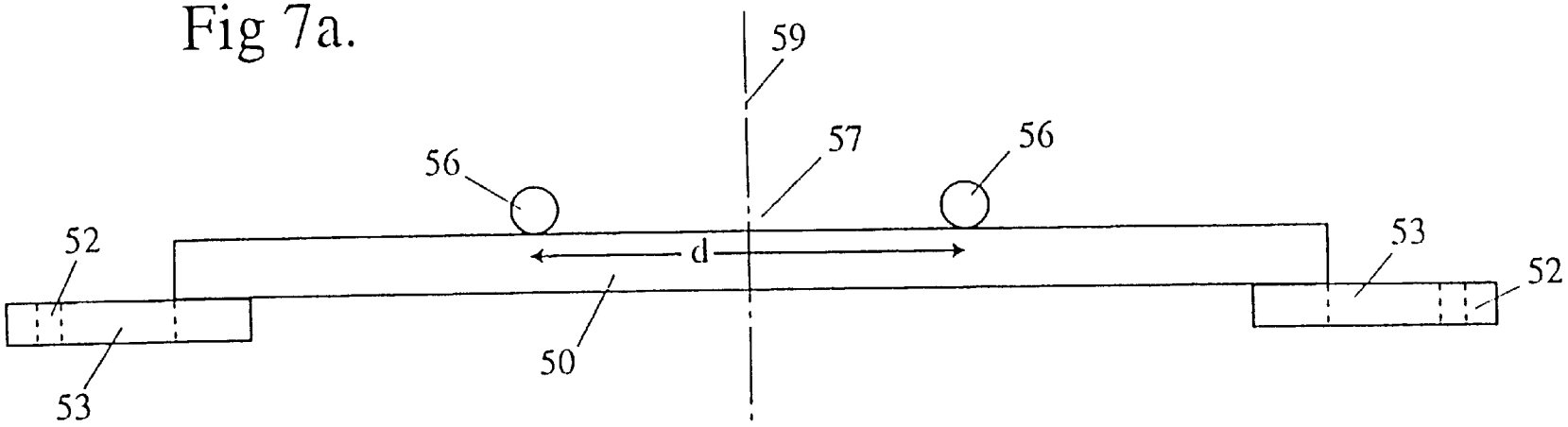
FIG. 7*a* shows an elevation of one example of a tie rod for use in accordance with a first preferred embodiment of the invention.
Figure 7B:
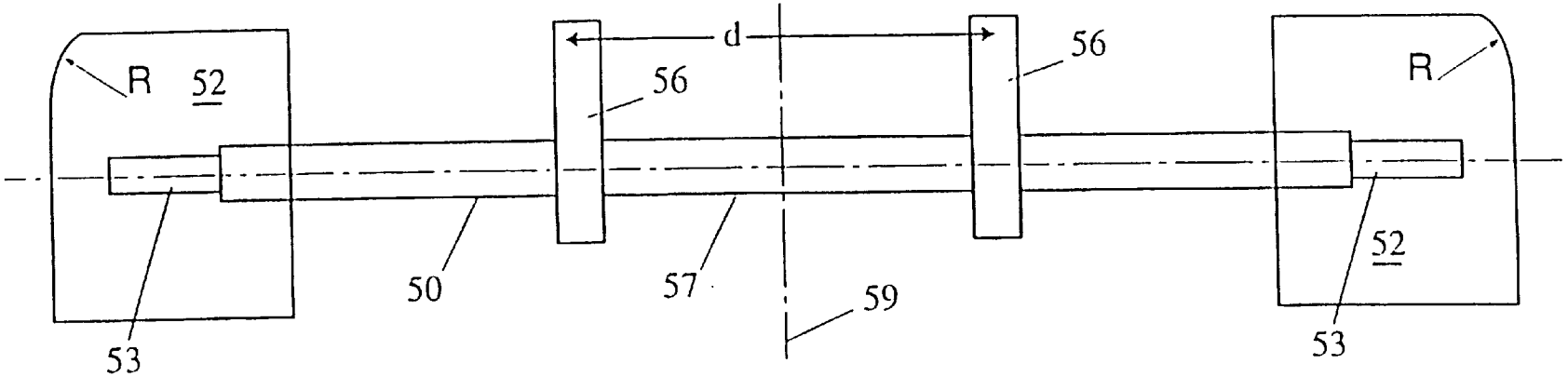
FIG. 7*b* shows a plan view of the tie rod of FIG. 7*a;*
Figure 8A:
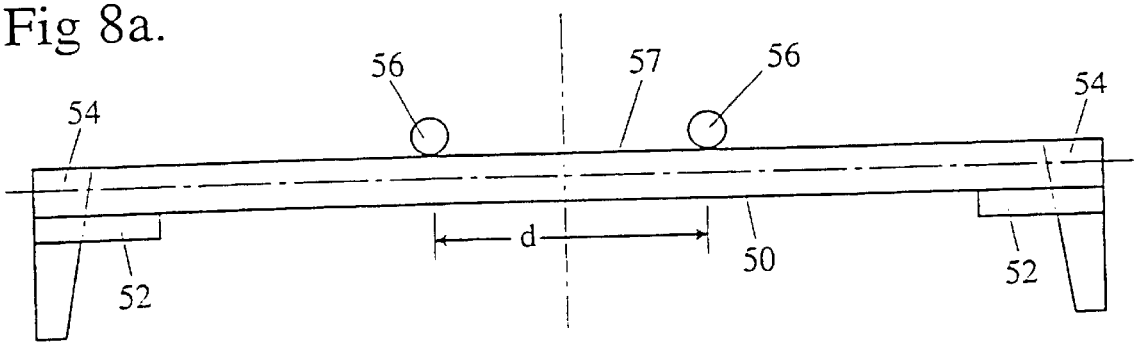
FIG. 8*a* shows an elevation of an alternative example of a tie rod for use in accordance with the invention.
Figure 8B:
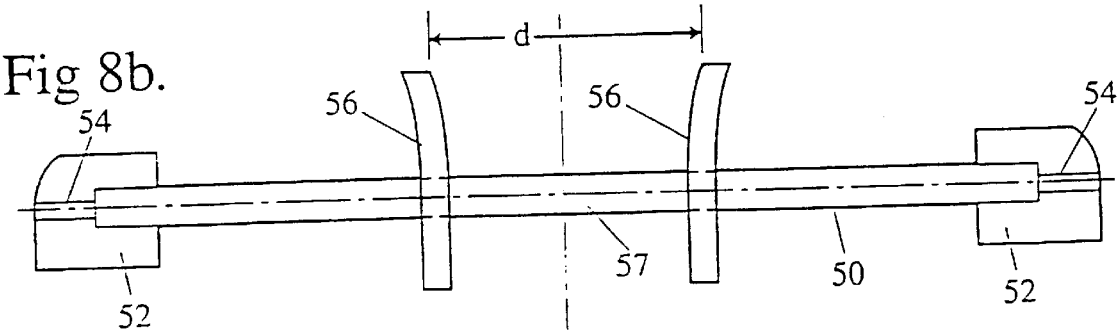
FIG. 8*b* shows a plan view of the tie rod of FIG. 8*a;*
Figure 8C:
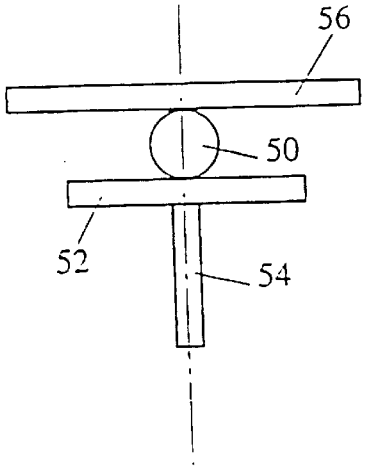
FIG. 8*c* shows an end elevation view of the tie rod of FIGS. 8*a* and 8*b;*

The main function of these small rectangular holes 13 in the web 12 of first module 10 is to provide positive connection and anchorage to the tie rod 50, as shown in FIG. 7 or 8, which connects first modules 10 together; or first and end modules 10 and 30 together when constructing the wall in accordance with the method of the present invention.

Figure 5A:
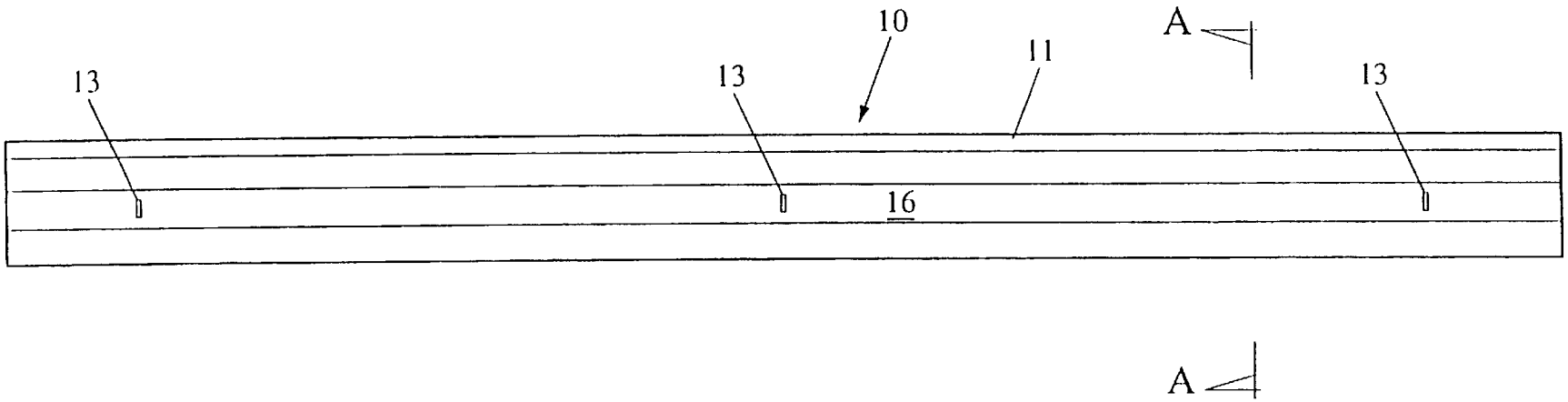
FIG. 5*a* shows a side view of one example of an alternative first module for use in a first preferred embodiment of the invention.
Figure 5B:
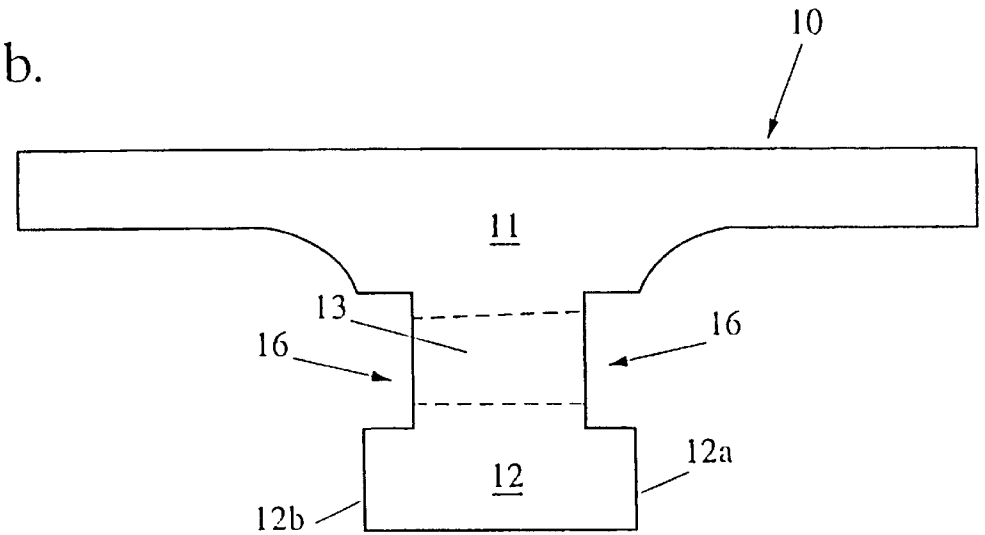
FIG. 5*b* shows a cross section view along section line A—A of FIG. 5*a;*
Figure 6A:
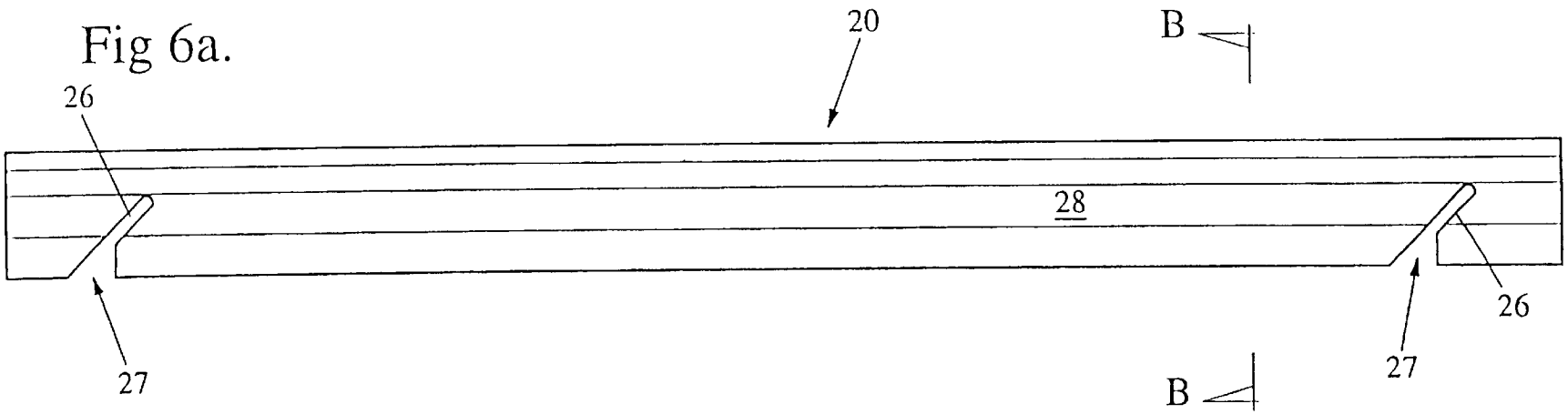
FIG. 6*a* shows side elevation of one example of an alternative second module for use in a first preferred embodiment of the invention.
Figure 6B:
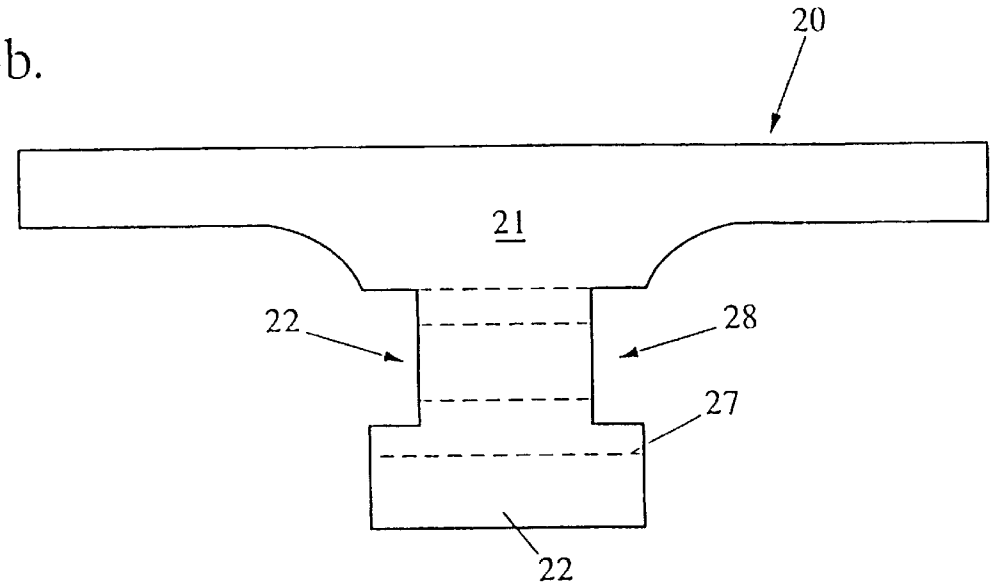
FIG. 6*b* shows a cross section view along section line B—B of FIG. 6*a;*

As shown in FIGS. 5 and 6, the webs 12 and 22 of each of the first and second modules 10 and 20 could also be provided with longitudinal recesses 16 and 28 which run the full length of the unit on both sides of the webs 12 and 22. The small rectangular holes 13 in the webs 12 of first modules 10 and the bevelled cuts 26 in the webs 22 of second modules 20 remain the same.

The Second Module

Referring more particularly to the second module 20, as shown in FIG. 2, this module is a plain concrete T-shaped cross section panel. The length of the panel is equal to the full height of the wall 40 being constructed. The width and thickness of the flange 21 and web 22 of the panel and the overall thickness of the panel depend on the design of the same wall 40.

Figure 3A:
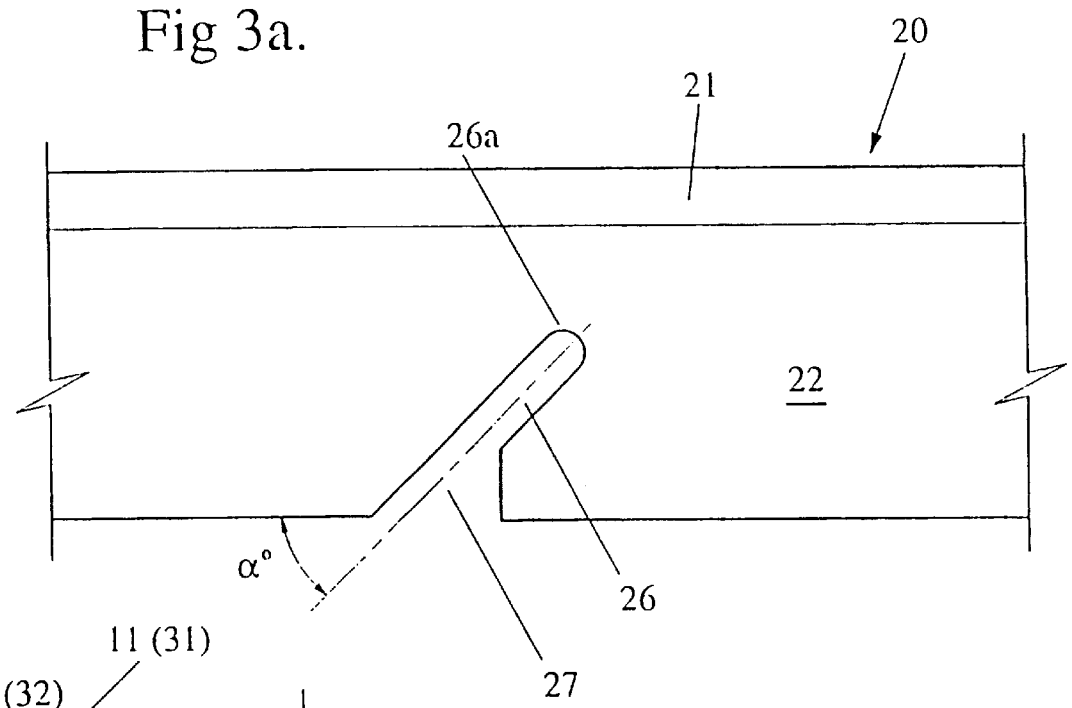
FIG. 3*a* shows a detail of the bevelled cuts shown in FIG. 2, and 6 one arrangement for connection of second modules to tie rods connecting first or first and end modules in a first preferred embodiment of the invention.
Figure 3B:
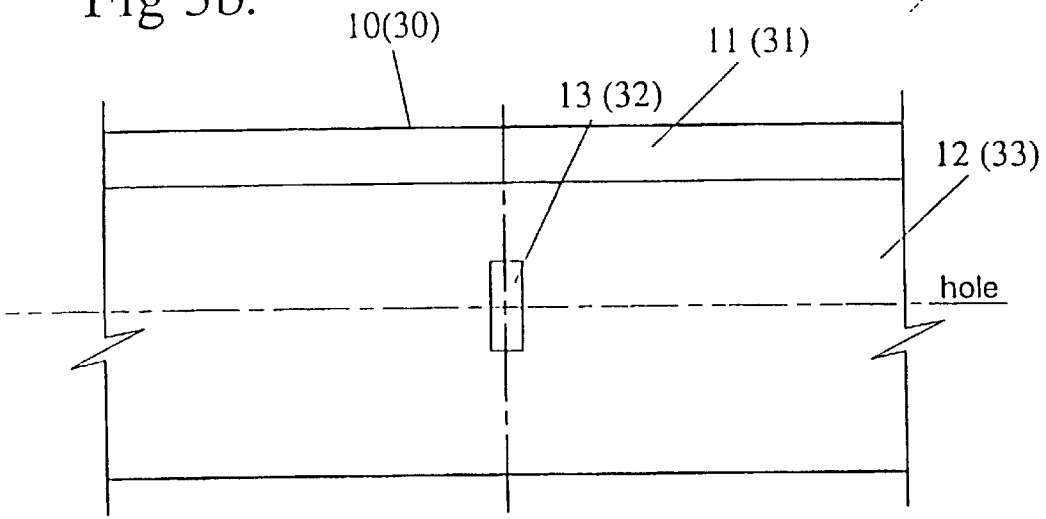
FIG. 3*b* shows a front elevation of portion of a web of a first or end module.

The second module 20 is similar to first module 10 in cross section, in length and in size. However, it has large angled slots 26 in its web 22. The smaller rectangular holes 13 which are provided in the web 12 of first module 10 are omitted. These large angled slots are in the form of bevelled cuts 26 at predetermined angle from the horizontal, for example 30° or 45° (see FIG. 3*a*) and locations, for example proximate the ends of the web 22 of the module 20. The ends 26*a* of slots 26 may be rounded. This results from a possible process of fabrication where holes are first drilled through web 22 at desired locations of the slots 26. An angled cut, at the required angle $\alpha°$, is then made to meet the drilled hole producing the slot shape shown. A horizontal cut is made to intersect this angled cut at its opening. Angles and location of cuts are selected having regard to required strength. The same bevelled cuts 26 are intersected by a horizontal cut 27 at the face of the web 22 to form the shape of cut shown generally in FIG. 2; and in detail in FIG. 3*a*. The number, size and angle of these bevelled cuts 26 depend on the height of the wall 40 to be constructed and on the design loading of the same wall 40. Two such bevelled cuts 26 located proximate the ends of the web should suffice. The width of these bevelled cuts 26 is selected to snugly fit the tie rod 50, shown in FIGS. 7 or 8, for connecting the first and second modules 10 and 20 together.

The main function of these bevelled cuts 26 is to guide, positively anchor and fix a second module 20 to a corresponding tie portion 57 of the tie rod 50 which connects first or end modules 10 or 30 together; and first and end modules 10 and 30 together (to form the supporting structure) to become part of a wall 40. Therefore, these same bevelled cuts 26 form the connection portions of second modules 20 which, through cooperative engagement with the corresponding tie portion(s) 57 of connecting tie rod(s) 50, effectively connect it to first, end or first and end modules 10 and 30 to form a wall 40 without the use of cement mortar, bolts, screws, or the like. Accordingly, the bevelled cuts 26 and horizontal slots 27 are a particularly important feature of this preferred embodiment of the invention.

Second modules 20 are also used in the construction of columns and piers in accordance with further aspects of the invention.

The End Module

End module 30 also takes the form of a plain concrete Half-T-Cross section panel (i.e. L- Cross-section panel) as shown in FIG. 4. The length of the panel is equal to the full height of the wall being constructed. The width and thickness of the flange 31 and web 33 of the panel and the overall thickness of the panel depend on the design of the same wall.

The external face of the web 33 of end module 30 is provided with a longitudinal recess 36, which runs the full length of the module 30. The width and depth of this longitudinal recess 36 is designed to suit keys and/or hook brackets, as shown in FIG. 25, allowing connection of end module 30 to other modules or fittings as described further below. Recess 36 may be omitted in half-modules as used in pier constructions as described below.

The web 33 of end module 30 is also provided along its length with the same size of small rectangular holes 32 as those provided in the web of first module 10. Also, the same number of holes 13 provided in the first module 10 correspond to an equal number of the same holes 32 provided in end module 30. For example, if first module 10 has three slotted holes 13 provided in its web 12 at a certain height, then three out of the larger number of slotted holes 32 provided in the web 33 of end module 30 must exactly correspond and be located at the same height and location along its web 33 as those provided in the web 12 of first module 10.

End module 30 may be provided with more of the same small rectangular holes 32 along the length of its web 33 than first module 10. These extra rectangular holes 32 are designed to provide anchorage and fixity for the window and door frames which may be fixed to the end module 30. End modules 30 are located on each side of the door and window openings and may be used for the shorter cut modules which may be located below and above an opening. End modules 30 may also be located to define a wet joint along the wall. They are also used at piers along a wall where connection of two end modules 30 may form a supporting structure for second module(s) forming at least part of a pier.

The main function of these small rectangular holes 32, which are provided in the web 33 of end module 30 is to, provide positive connection and anchorage, to the tie rod 50 which connects first and end modules 10 and 30 together. Also, these holes 32 allow connection of the door and window frames by bracket means described further below.

2. The Connection or Tie Means

The connection or tie means ties and connects the first, second and end modules 10, 20 and 30 together in order to form a wall 40 of desired rigidity and strength. It includes, in a preferred embodiment of the invention, a tie rod; a key and wedge; a capping; hook bolt(s) and hook brackets.

The tie rod 50 may, in one embodiment shown in FIG. 7, be a short metal rod with specially designed lug (plate) 52 connected at each end. Rectangular hole 53 is formed in each lug 52 to accommodate separate wedge components 85 to anchor the tie rod to key apertures as described below. The lugs 52 may be designed to suit the shape of the webs 13, and 33 of the first and end modules 10 and 30. The lugs 52 may be omitted by suitable design of the tie rod 50.

An alternative tie rod is shown in FIG. 8. This alternative includes wedges 54 designed to suit the rectangular holes or slots 72 provided in key apertures. These wedges 54, in contrast to wedges 85 described below, are incorporated in the lugs 52 of the tie rod 50.

Referring further to FIG. 7, the tie rod 50 is also provided with two locating guides 56 along its length, which could be rods of any suitable cross section, or plates of any shape and size. Guides 56 may be welded to tie rod 50. Further or fewer guides could be provided, for example corner tie rods 150 have two sets of guides 56 and 156 and tie rods for piers have no guides, rather guiding is achieved by the channel sections of the pier brackets as described below. The spacing "d" between these two guides 56 is designed to suit the width of the web 22 of second modules 20. A neat fit may be desired. These guides 56 are designed to guide, locate and restrain second modules 20 into desired positions along the wall 40, when it is anchored to the tie rod 50 which connects first modules 10 together; and/or first and end modules 10 and 30 together to form the wall 40; or two end modules together to form a pier or column.

The guides 56 need not be located symmetrically about a centre line between the lugs 52. Their position is selected having regard to the desired position of second modules 20 in the constructed wall 40.

The overall length of the tie rod 50 (including the lugs 52) is designed to suit the flange width of the modules 10 and 30 so that when connected together by the tie rod 50 the desired spacing, centre to centre, required between them is advantageously achieved.

Moreover, the same tie rod 50 may be bent and modified in length and profile as required and is also used to tie or connect together the modules which form the external and internal corners of walls meeting at different angles and the modules forming a pie or column or any other structural member.

Figure 9:
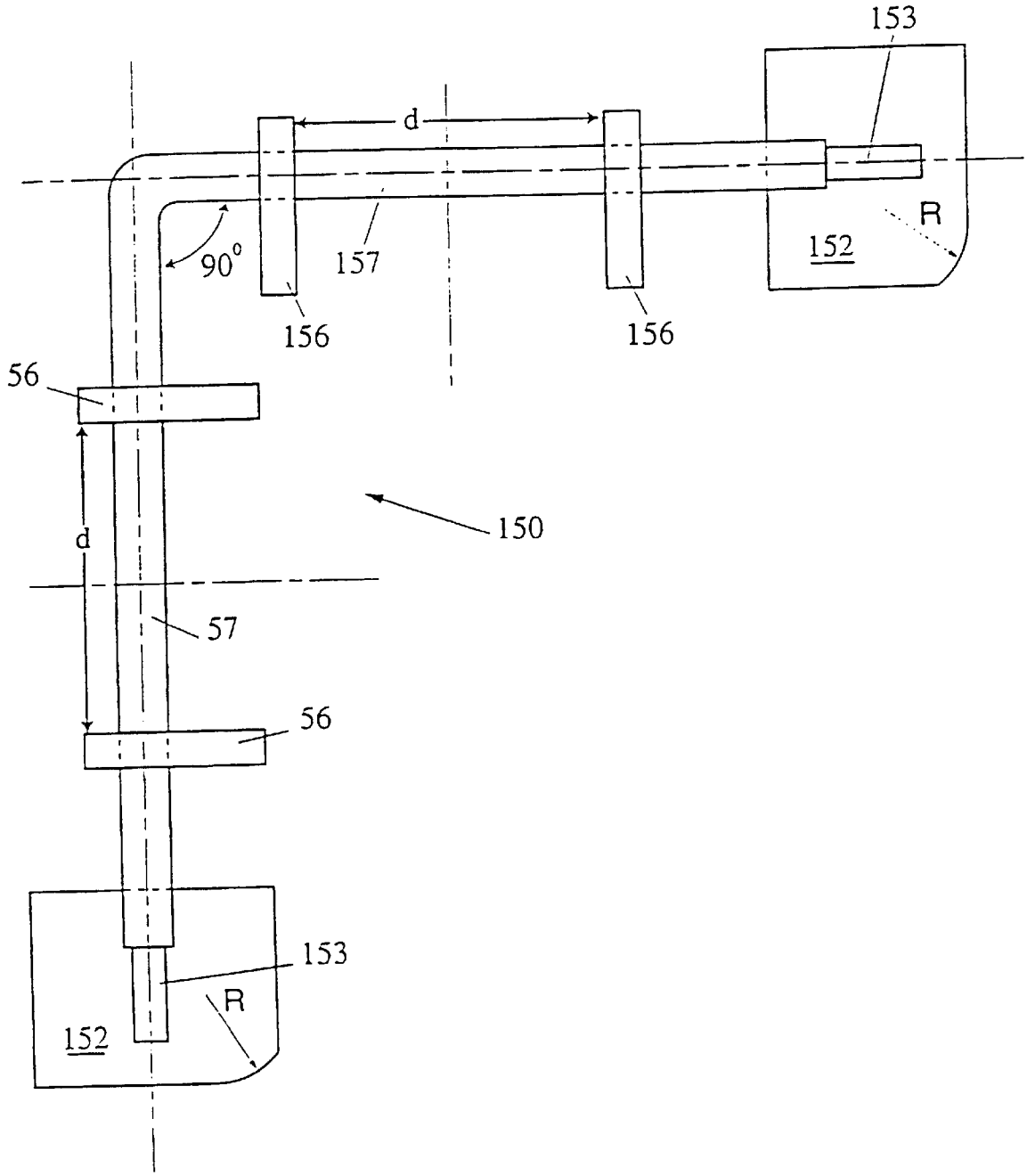
FIG. 9 shows a plan view of one example of a tie rod to be used at a corner formed by two walls meeting at right angles and constructed in accordance with the method of the invention.
Figure 10:
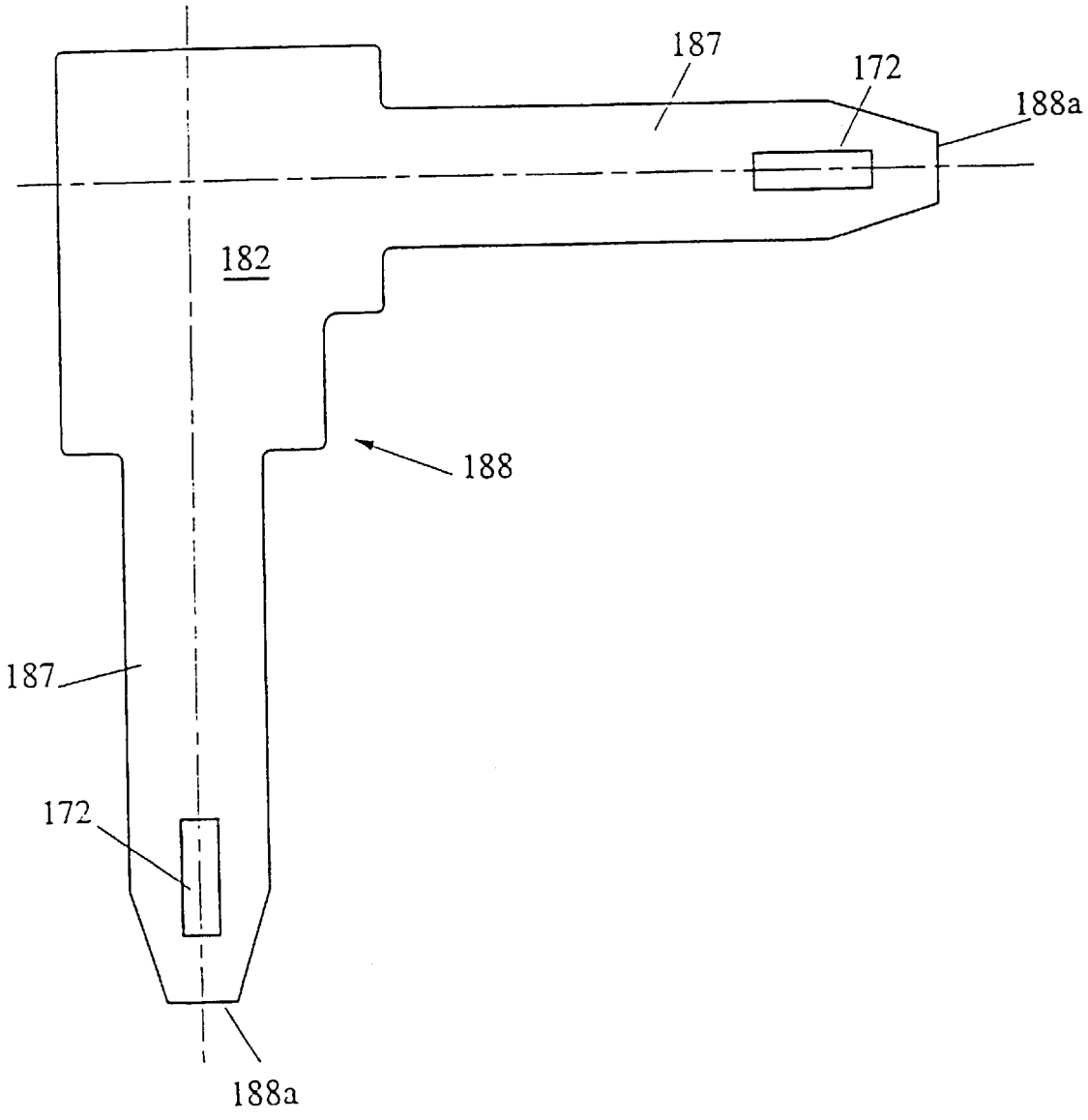
FIG. 10 shows a plan view of one example of a key for use at a corner in accordance with one embodiment of the present invention.
Figures 15A, 15B:
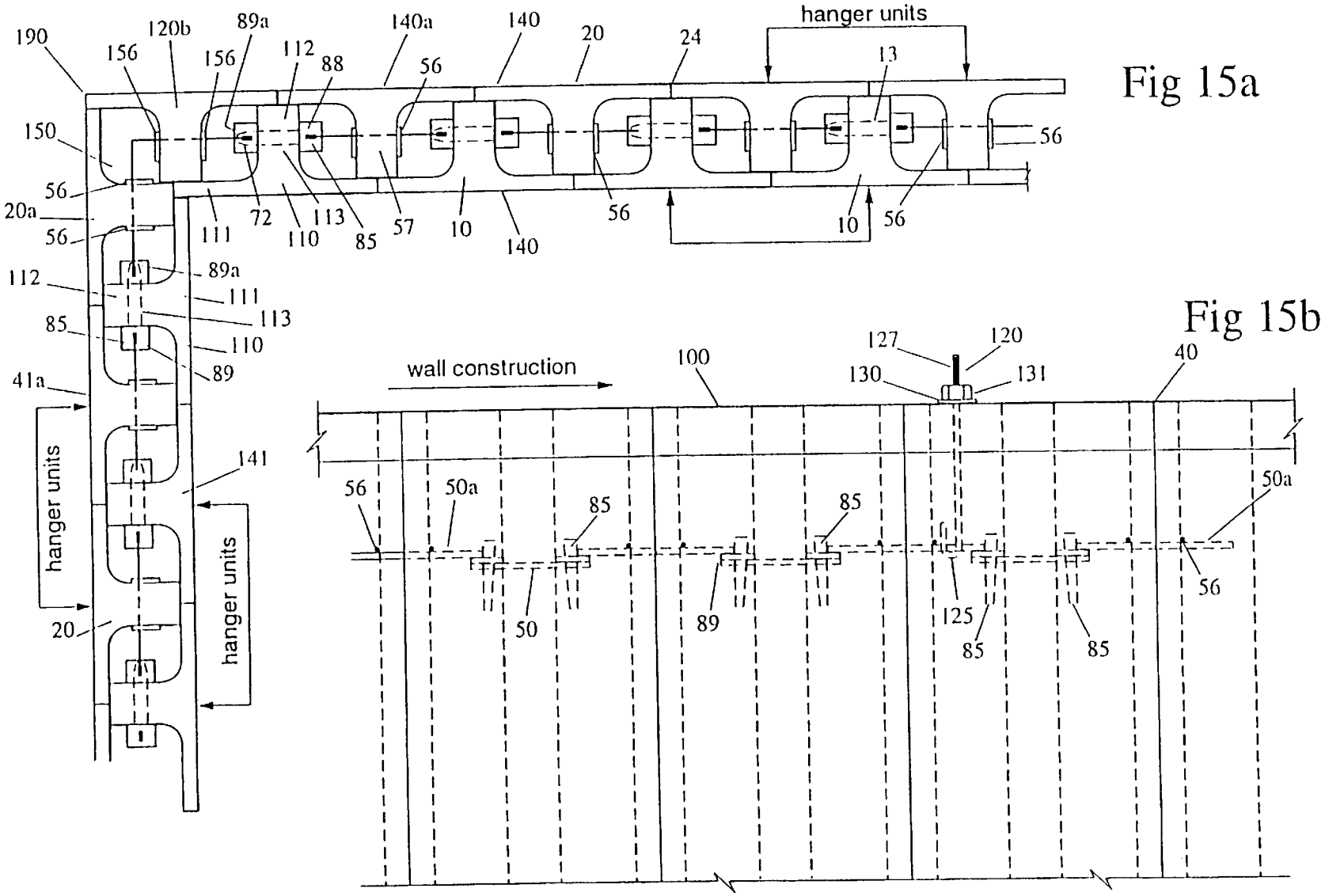
FIG. 15*a* shows a plan view of one example of an external comer formed by two walls meeting at right angles and assembled in accordance with one embodiment of the invention.
FIG. 15*b* shows a part elevation of the wall shown in FIG. 15*a;*

Referring to FIG. 9, there is shown a suitable tie rod 150 for a right angle corner, each arm of which extends in a direction of one of the walls forming the corner (see FIG. 15*a*). This angle may be varied of course to allow cornering at different angles than 90°.

The main function of the tie rod 50 is to tie and connect the first modules 10 together; and first and end modules 10 and 30 together to form one face of, the wall or two end modules 30 together to form a pier, and to provide positive anchorage and fixity to second modules 20 which connect to the tie rod 50 to form the opposite face of the same wall 40; or a pier or column. The tie rod 50 also transmits the horizontal and longitudinal forces acting on the same wall. Two or more such tie rods 50 may be employed in the connection of adjoining modules.

Tie rods connecting first modules may be referred to herein by notation including "50" in this description. Modified tie rods may be designated by notation including "51", for example those tie rods connecting end modules 30 or first and end modules 10 and 30.

Keys 88 and 89, shown in FIG. 11, perform in conjunction with wedge 85 two important functions. Firstly, they lock and fix the tie rod 50 to the first, and end modules 10 and 30 on driving wedges 85 into position.

Secondly, the keys fix window frame and/or door frame brackets to end modules 30 on driving wedges 85 into position.

Keys 88 or 89 and wedges 85 may be used in combination though key means could be designed to achieve both functions. To illustrate how the keys 88, 89 and wedges 85 work, consider for example two vertical surfaces which need to be locked and fixed firmly together by means of the key and wedge. The two surfaces must first be provided with the same size holes to fit the key being used. The two surfaces are brought together with the holes aligned. A key is inserted through the holes of both surfaces. A wedge 85 is then driven through the rectangular hole 72 provided at the pointed end of the key 88 or 89 to secure both surfaces together. The further the wedge 85 is driven into the hole(s) 72 the bigger the compression force applied and the tighter the two surface are gripped together.

Figure 11D:
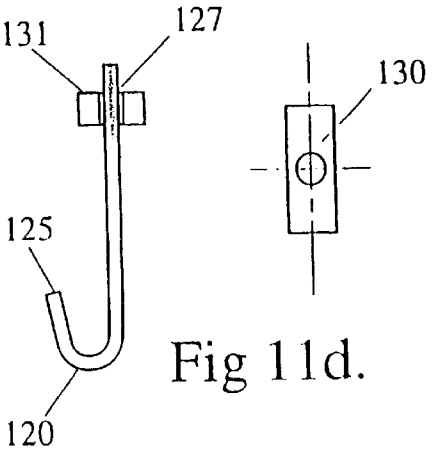
FIG. 11*d* shows one example of a hook bolt and washer which may be used in accordance with the method of the invention.
Figure 11C:
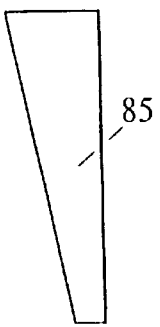
FIG. 11*c* shows one example of a wedge which may be used in accordance with a first preferred embodiment of the method of the invention.
Figure 11B:
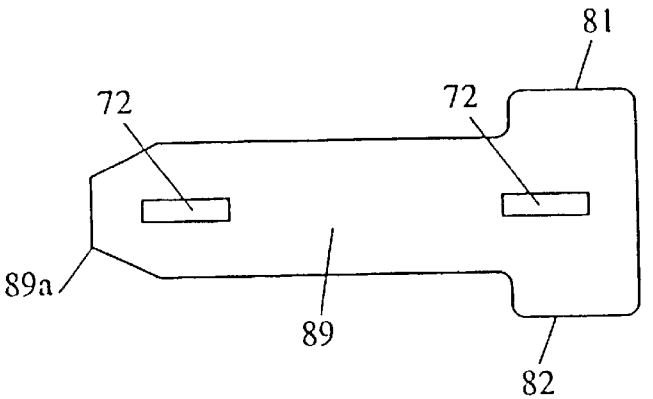
FIG. 11*b* shows plan and elevation views of a second type of key which may be used in a first preferred embodiment of the method of the invention.
Figure 11B:
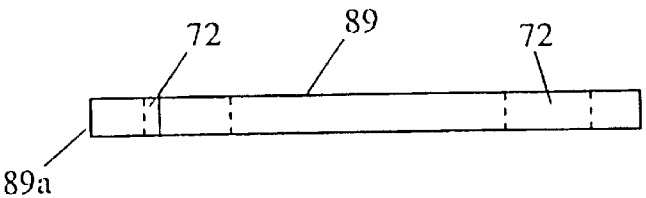
Figure 11A:
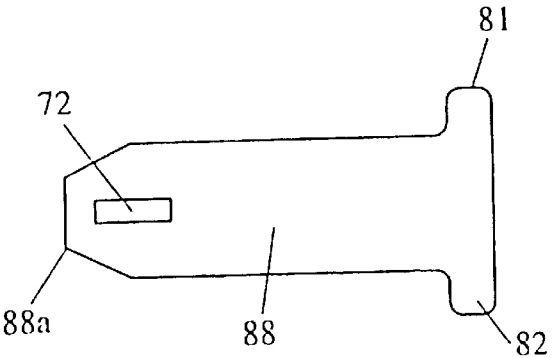
FIG. 11*a* shows plan and elevation views of one type of key which may be used in a first preferred embodiment of the method of the invention.
Figure 11A:
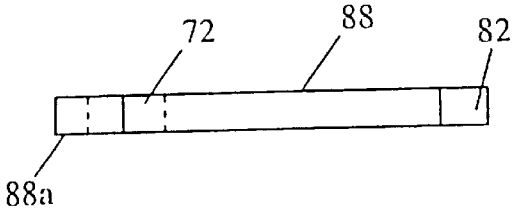

The key 88 or 89 may take the form of a rectangular metal plate of width and thickness to suit and. shaped as shown in FIGS. 11*a* and 11*b*. Keys are designed to fit the small rectangular holes 13 and 32 provided in the webs 12 and 33 of the first and end modules 10 and 30. One end 88*a* or 89*a* of the key 88 or 89 may be slightly tapered or pointed to facilitate fitting it through the small rectangular holes 13, 32 in the webs 12, 33 of the modules 10 and 30 and the other end 81 is provided with a wide flange 82 to stop it from passing completely through the same holes.

Two types of keys may be used in accordance with the invention. One type (type "E") 88 is provided with only one rectangular hole 72 at its pointed end 88*a*. A second type (type "I") 89 is provided with two rectangular holes 72 one, at each end of the key.

Each of the above key types could be made in different length and profile, for connection of different modules at different locations to perform different functions. Type E keys 88 are used with end modules 30 at the end of a wall 40 or along the sides of window or door openings in order to lock and fix the door or window frame bracket to an end module. A modified key 188 with right angled key arms 187 is used at a right angle corner and at walls meeting at different angles. Arms 187 may be disposed at different angles for different-angle corners and may be provided with apertures 172 to accommodate wedges 85.

Type "I" keys 89, used in connection of first modules 10, could have different shapes and different lengths depending on their location along the walls being constructed, however function remains the same. Appropriate shape and length keys are selected by the builder during construction.

The keys provide positive anchorage and fixity to the tie rod 50. The keys 88 and 89 also transmit the design longitudinal and horizontal loads from one module to the next through the tie rod 50.

The wedge 85 is a small piece of metal plate, straight on one side and tapered on the other as shown in FIG. 11*c*. The metal of the wedge 85 may be substituted by other materials. It is designed to fit the rectangular slot(s) 72 provided in the keys 88 and 89 and in the lugs 52 at each end of the tie rod 50. It is used in conjunction .with keys for locking, tying and fixing the modules together and for locking and fixing any brackets to first, second and end modules 10, 20 and 30 by wedging action.

The cappings, shown in FIG. 12, are generally C-shaped sheet metal cappings. The width of cappings 100 and 180 is designed to suit the thickness of the wall 40 being built and its length may vary to suit the construction of the same wall 40, the handling and transport.

Two types of capping 100 and 180 have been designed to be used in accordance with the invention, as shown in FIG. 12*a–d*. The capping 100 shown in FIGS. 12*c* and 12*d* may be a plain capping which is a C-shaped sheet metal capping which has no cleats attached to its web and it may or may not have large voids 101 in its web 107. It could be used on top as well as at the bottom of the wall being built.

Figure 12A:
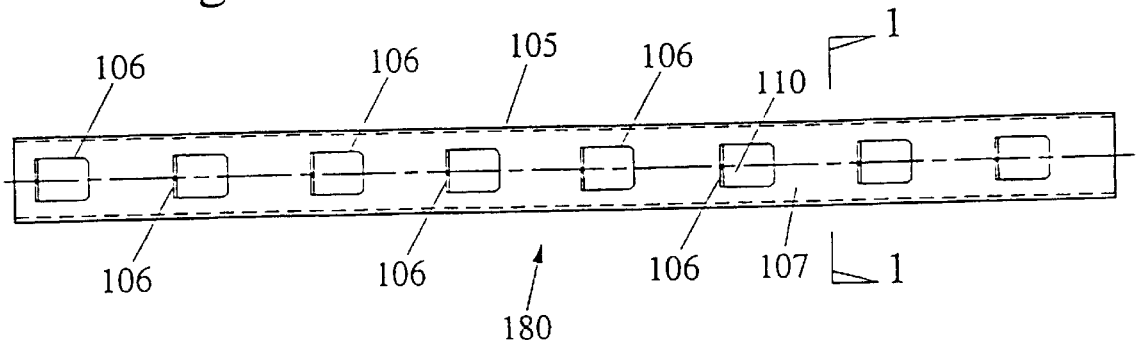
FIG. 12*a* shows a side elevation view of one example of a capping for a wall used in a first preferred embodiment of the invention.
Figure 12B:
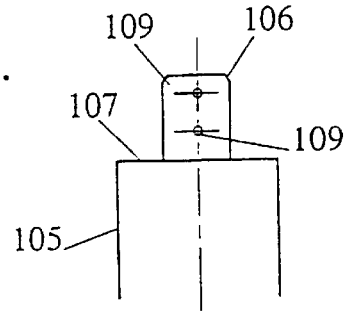
FIG. 12*b* shows a section view of the capping along section line 1—1 of FIG. 12*a;*
Figure 12C:
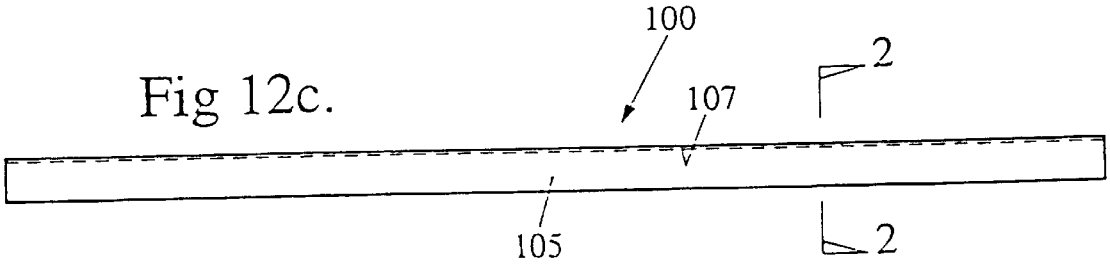
FIG. 12*c* shows a side elevation view of a further example of a capping for a wall used in a second preferred embodiment of the present invention.
Figure 12D:
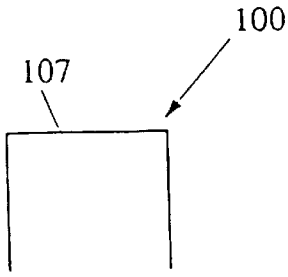
FIG. 12*d* shows a section view of the further capping along section line 2—2 of FIG. 12*c;*

The capping may be a castellated and/or cleated capping 180, as shown in FIGS. 12*a* and 12*b*. This capping 180 is also a C-shaped sheet metal capping except it is provided with cleats 106 at the outside face of its web 107. These cleats 106 could be punched through the web 107 of the plain C capping 100 at the required centres and folded outwards leaving large voids in the web 107 of the C channel to form a castellated cleated capping 180. Alternatively, the cleats 106 could be welded on the outside web 107 of the capping 180 and the large voids in the web 107 punched separately or the metal C section could be manufactured with large voids 101 in its web 107 and cleats 106 welded to the web 107 to produce a castellated cleated capping. This type of capping 105 is used only at the top of the wall 40. It is designed to provide fixity to other structural members supported on the top of the same wall such as ceiling joists, roof rafters and roof beams. Holes 109 are drilled in the cleats 106 to allow connection to these structural members.

The capping 100 or 180 connects the modules 10, 20 and 30 forming the wall together at the top of the wall 40, and assists in alignment of the modules, to distribute part of the horizontal and vertical forces along the wall, to provide restraint at the bottom of the wall 40 if and when required by fixing the capping to the floor and to provide fixity at the top of the wall 40 for other structural members which bear on top of the wall such as ceiling joists, roof rafters, roof beams etc. Capping length may be the length of a flange of a first module 10, greater or less as desired.

The cappings 100 or 180 could be made from suitable materials other than metals. They may be shaped to suit columns or corners.

The cappings 100 or 180 may be connected to the wall 40 by hook bolts 121 if required due to expected loadings. Suitable hook bolts 121 are hot dipped galvanised bolts (or any other approved rust treated bolts) one end 125 of which is bent in the shape of a hook and the other end 127 of which is threaded to fit a suitable nut 131 and a rectangular washer 130, as shown in FIG. 11*d*.

The diameter of the hook bolts 121 vary, depending on the height of the wall 40*d* the wind and other loadings acting on the same wall 40. The length of the hook bolts 121 is designed to suit the position of the nearest top tie rod 50 or 51 to which it connects. The washers 130 may take the form of a rectangular flat metal washers. The length of the washer 130 is equal to the full thickness of the wall 40 and its width and thickness are proportioned to suit the design of the bolt 121.

The capping 100 or 180 is fixed to the top of the wall 40 hooking the hook bolt 121 to the top tie rod 50*a* which ties the modules 10 and 30 together and bolting the rectangular washer 130 across the thickness of the wall 40 and on top of the capping 100 or 180 as shown in FIGS. 15 and 16.

Construction of a Wall

Figure 14:
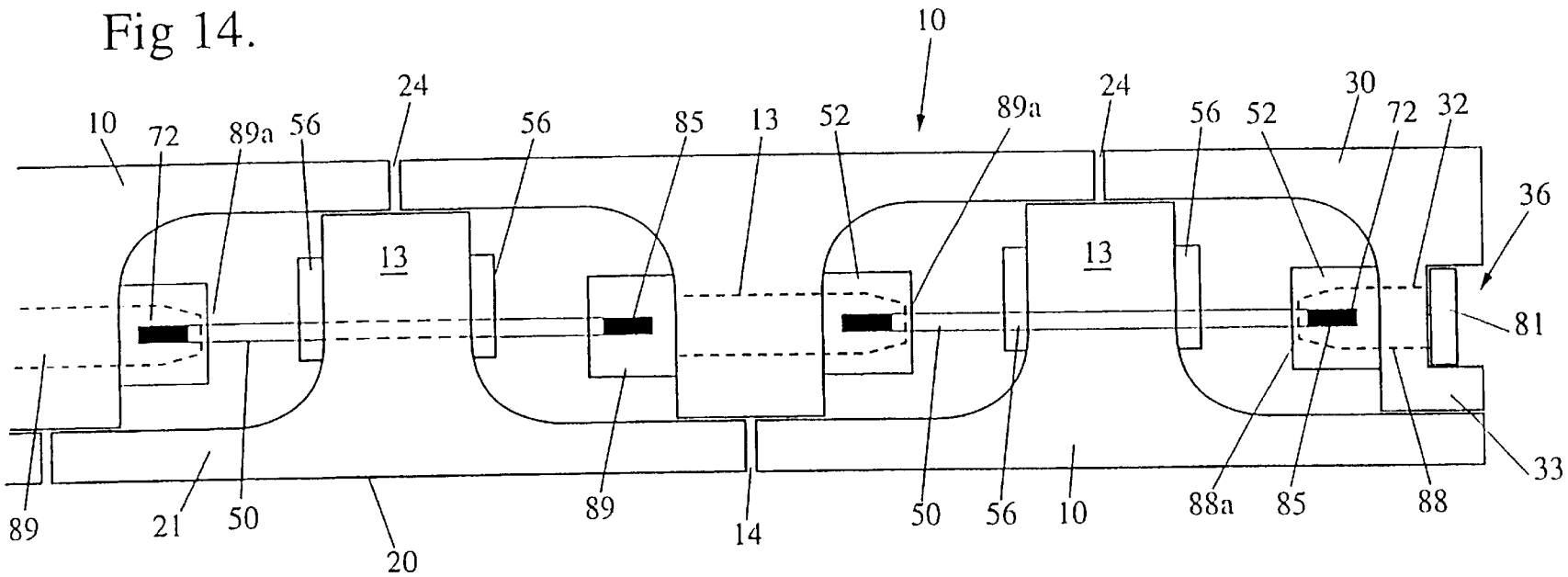
FIG. 14 shows an enlarged detail of FIG. 13*a;*

Description now follows of the assembly of modules, tie rods and capping to form a wall referring to FIGS. 13*a*, 13*b* and FIG. 14.

Construction of a wall 40 may start anywhere along the wall at a first module 10; or with an end module 30 forming a start or an end to the wall 40; or at a corner. For illustrative purposes, construction will be assumed to start at an end module 30. The end module 30 is stood in an upright position with its flange 31 running along the line of the wall to. be constructed. One type E key 88 is fitted to the top and one to the bottom of the end module 30 in the small rectangular holes 32 provided through its web 33. The pointed ends 88*a* of these keys 88 must poirt in the direction of the wall 40 being constructed in distinction to other keys 89, used in forming the wall 40, which face in the opposite direction. The height at which these keys 88 are fixed correspond to the height of the bevelled cuts 26 provided in the web 22 of second modules 20.

Then a first module 10 is stood next to the end module 30 with its flange 11 also extending along the same line of the wall 40 as flange 31 of end module 30. A type "I" key 89 is then to be fitted in each of the slotted holes 13 provided through its web 12. One type "I" key 88 is fitted at the top and one is fitted at the bottom of the module 10. The pointed end 89*a* of the key 89 faces against the direction of the wall 40 being constructed (see FIGS. 13*a* and 14).

Now the end and first modules 10 and 30 are ready to be connected or tied together with the modified tie rod 51, having shorter length than tie rod 50 used in connection of adjacent first modules 10, forming an assembly which is a supporting structure 200 for second modules 20. The supporting structure 200 effectively forms a hanger from which a second module 20 is "hung" to form part of the wall. It may be called a hanger unit.

Starting at the bottom, then at the top of modules 10 and 30, tie rods 51*b* and 51*a* respectively are slid between the webs 13 and 33 of the standing modules 10 and 30. Wedges 85 are then driven securely into the rectangular holes 72 provided in the keys 88 and 89 in both modules 10 and 30 and in the lugs 52 provided at each end of tie rods 51*a* and 51*b*. Once the bottom and the top tie rods 51*a* and 51*b* are anchored into position by the keys and wedges 88, 89 and 85 the two modules 10 and 30 are locked together in the longitudinal direction of the wall 40 and spaced at the required centres. The first and end modules 10 and 30 have flanges forming one face 40*a* of the wall 40 and, connected by the two tie rods 51*a* and 51*b* between them, form the hanger-unit 200.

A second module 20 is then stood in the upright position and opposite the hanger unit 200 formed by the first and end modules 10 and 30 such that its web 22 is facing and in line with the centre line 59 of the guides 56 provided on the tie rods 51*a* and 51*b*.

The second module 20 is now lifted slightly and allowed to temporarily hang off the top tie rod 50*a* and between the guides 56 provided on it, by the top horizontal cut 27 provided in its web 22. The second module 20 has the bottom bevelled cut 26 in its web 22 guided between the bottom tie rod guides 57*b*. The second module 20 is then simply pushed gently forward against the other two standing modules 10 and 30. This will allow module 20 to drop over and engage corresponding portions 57*a* and 57*b* of the top and bottom tie rods 51*a* and 51*b* with the cooperating bevelled cuts 26 anchoring and locking it to the tie rods 50*a* and 50*b*, thus forming the opposite face 40*b* of the wall 40. Flange 21 ends overlap webs 11, 31 or 11 and 31 of first and/or end modules 10 and 30 forming supporting structure. Spaces 24 separate the flange 21 ends of adjoining second modules, and indeed first and/or end modules 10 and 30. These may be used for insertion of brackets, other fittings but may be rendered or plastered if desired. The three modules 10, 20 and 30 are thus now locked effectively together in both longitudinal and horizontal directions thus forming part of the wall 40 being constructed.

Then another first module 10 is placed in the upright position with its flange 11 along the line of the wall 40 next to the previous first module 10. Top and bottom keys type "I" 89 are fitted into position through the rectangular holes 13 in its web 12, and in line and level with the previous ones. The pointed ends 89*a* of the keys must be facing against the direction of the construction of the wall 40, (i.e. facing the start of the wall). Two more tie rods 50 are inserted between the two first modules 10 and anchored into the keys 89 of this new unit and the last one thus again forming another hanger unit 201. Another second module 20 is hung between them and anchored to the tie rods 50 and so on. The same procedure is repeated until the construction of the wall 40 is complete.

The wall capping 100 or 180 and the hook bolts 120, if required, may also be fitted as the wall construction progresses or whenever is convenient. Depending on the height of the wall 40, temporary propping to the wall might be necessary until the wall is made secure but scaffolding are unnecessary.

On construction of external walls, internal walls may be constructed in the same manner. Structural members located at the top of the walls are assembled on completion of wall construction.

There is now described, with reference to FIGS. 15*a* and 15*b*, construction of an external corner of an external wall 140 of a structure, for example a house. In this case, flanges of first modules 110 form the internal faces 140*a*, 141*a* of the cornering walls 140, 141 and flanges of second modules 120 form the external faces 140*b*, 141*b* of the walls 140, 141.

Starting at the corner 190, two first modules 110 are stood upright at right angles to each other. Their flanges 111 run along the internal face of the wall in each direction and their webs 112 face the external face 140*b* of the wall 140. Two type I keys 89 are fitted into the rectangular holes 113 at the top and bottom of each module 110. The pointed ends 89*a* of the keys 89 point towards the comer 190.

The modules 110 may then be connected together by the corner tie rod 150 shown in FIG. 9 to form an assembly which is a supporting structure for two second modules 120*a* and 120*b*. Two such corner tie rods 150 are connected between the webs 112, one at bottom, the other at top; and secured by driving wedges 85 into the apertures 172 of the tie rods 150. The first modules 110 are tied together in the longitudinal direction of each line of the walls 140 and 141 forming the corner 190.

Second modules 120 used at corners are similar to second modules 20 used elsewhere but do have width of their flanges 122 modified or shortened to suit the corner 190.

Second module 120*a* is more easily connected first to the supporting structure 200 and second module 120*b* is connected afterwards completing the external corner 190.

The remainder of each wall 140 and 141 is constructed in the manner above described. Another first module 10 is stood next to first module 110 with its flange 111 running along the same line of the wall. Type I keys 89 are fitted into the top and bottom rectangular holes 132 provided in its web 112. A tie rod 50 is slid between the webs 112 of the two modules 110 at top (50*a*) and bottom (not shown) to engage with the keys 89. Wedges 85 are driven at each end of each tie rod 50 to secure and anchor them to the keys 89 forming hanger unit 200. Second module 20 is then connected to the same tie rods and so on until the cornering walls 140 and 141 are completed.

Figures 16A, 16B:
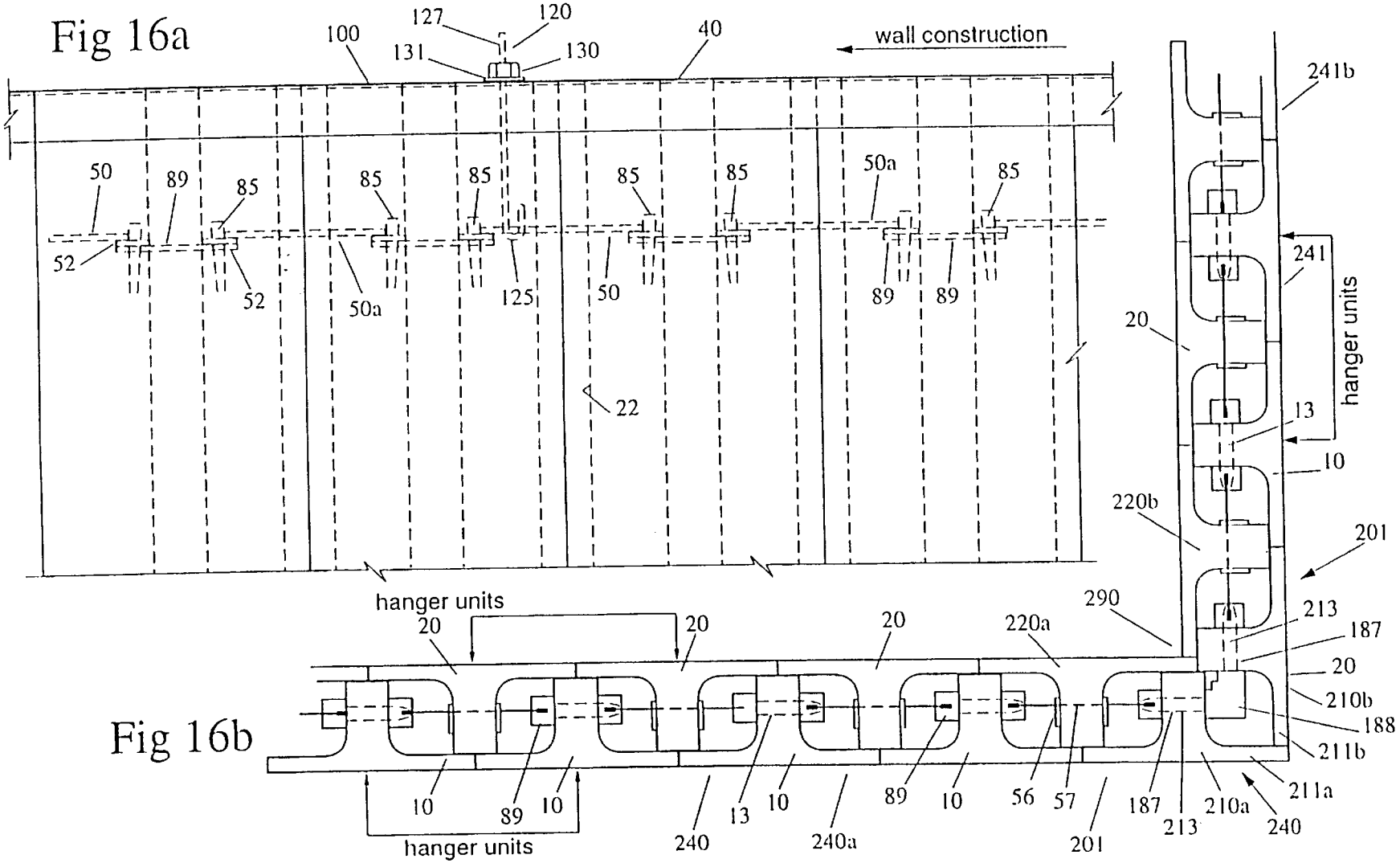
FIG. 16*a* shows a plan view of one example of an internal corner formed by two walls meeting at right angles and assembled in accordance with one embodiment of the invention.
FIG. 16*b* shows a part elevation of the wall shown in FIG. 16*a;*

There is now described, with reference to FIGS. 16*a* and 16*b*, construction of an internal corner 290 of an external wall 240. A first module 210*a* is fitted at top and bottom rectangular holes 213 in its web with one key arm 187 of corner key 188. The other key arm 187 of key 188 is fitted into corresponding rectangular holes of first module 210*b* stood at right angles to first module 210*a*. The first modules form part of adjoining supporting structures. Both key arms 187, which are disposed at a right angle, point away from corner 290. The flanges 211*a* and 211*b* are modified or shortened to suit the corner 290. The flanges 211*a* and 211*b* have the same length as flanges of second modules 120*a* and 120*b* forming the corner of FIG. 15.

Then further first modules 10 are connected to the first modules 210*a* and 210*b* by tie rods 150 engaged with the key 188 and 89 by driving wedges 85 into position. This completes assembly of supporting structures or hanger units 200 for the second modules 220*a* and 220*b* which are connected, in the manner previously described, to the hanger units 200. Second module 220*a* is more easily connected first followed by second module 220*b*. The corner 290 should be water-tight with no gaps allowing passage of water.

Construction of the cornering walls 240*a* and 240*b* continues as previously described.

Construction of Piers

Figure 17A:
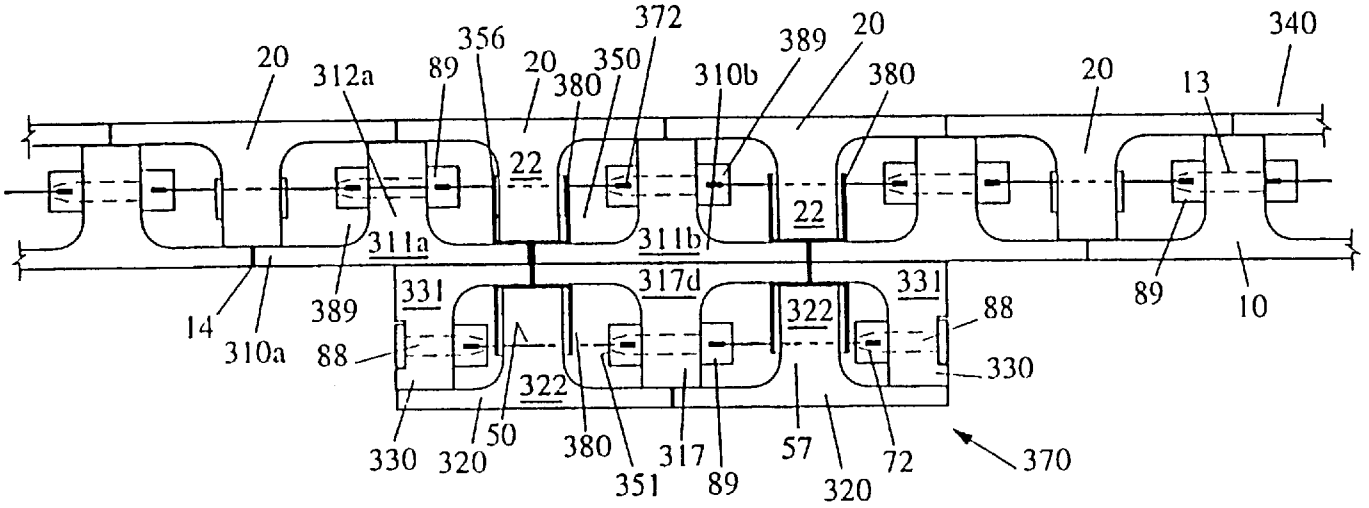
FIG. 17*a* shows a plan view of one example of a double module pier, assembled in accordance with one embodiment of the invention.
Figure 17B:
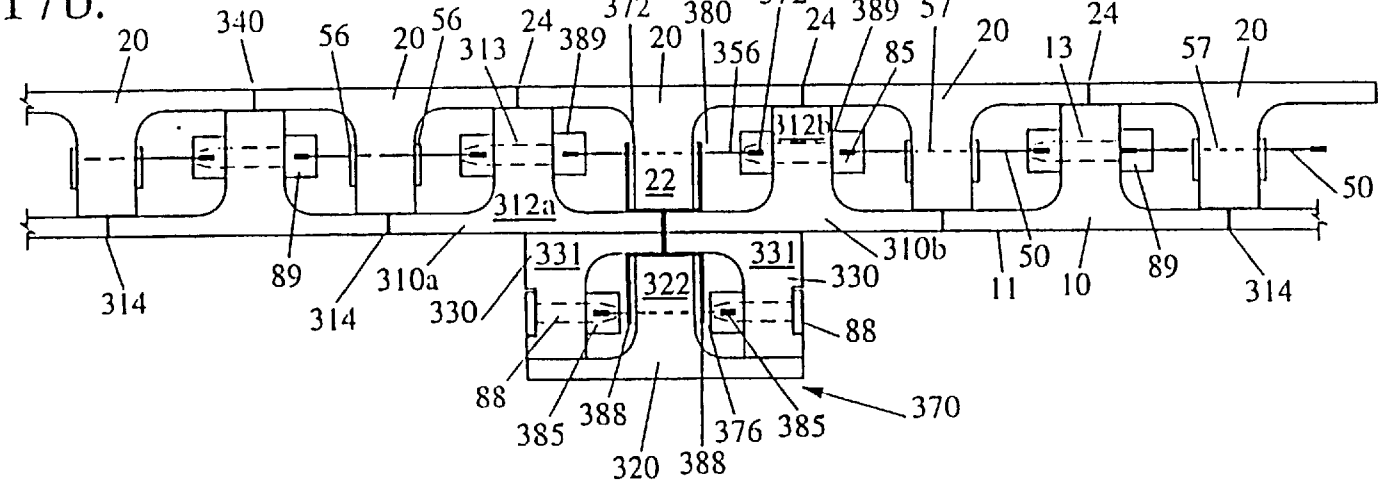
FIG. 17*b* shows a plan view of one example of a single module pier assembled in accordance with one embodiment of the invention.

There is now described, with reference to FIGS. 17*a* and 17*b*, the construction of a piered wall. Piers 370 may be constructed along a wall 340 in order to strengthen the wall, to carry a special load acting on the wall and to give extra lateral stability to the wall.

In accordance with this aspect of the invention, piers may be constructed anywhere along the length of a wall provided that second modules 20 and 320 of the wall and pier being constructed are directly opposite each other with their webs 22 and 322 facing each other when connected to the tie rods 50.

Two types of pier may be constructed. A single module pier (FIG. 17*b*) has width formed from one module. A multi-module pier (FIG. 17*a*) has width formed from a number of modules.

Figures 21A, 21B, 21C, 21D:
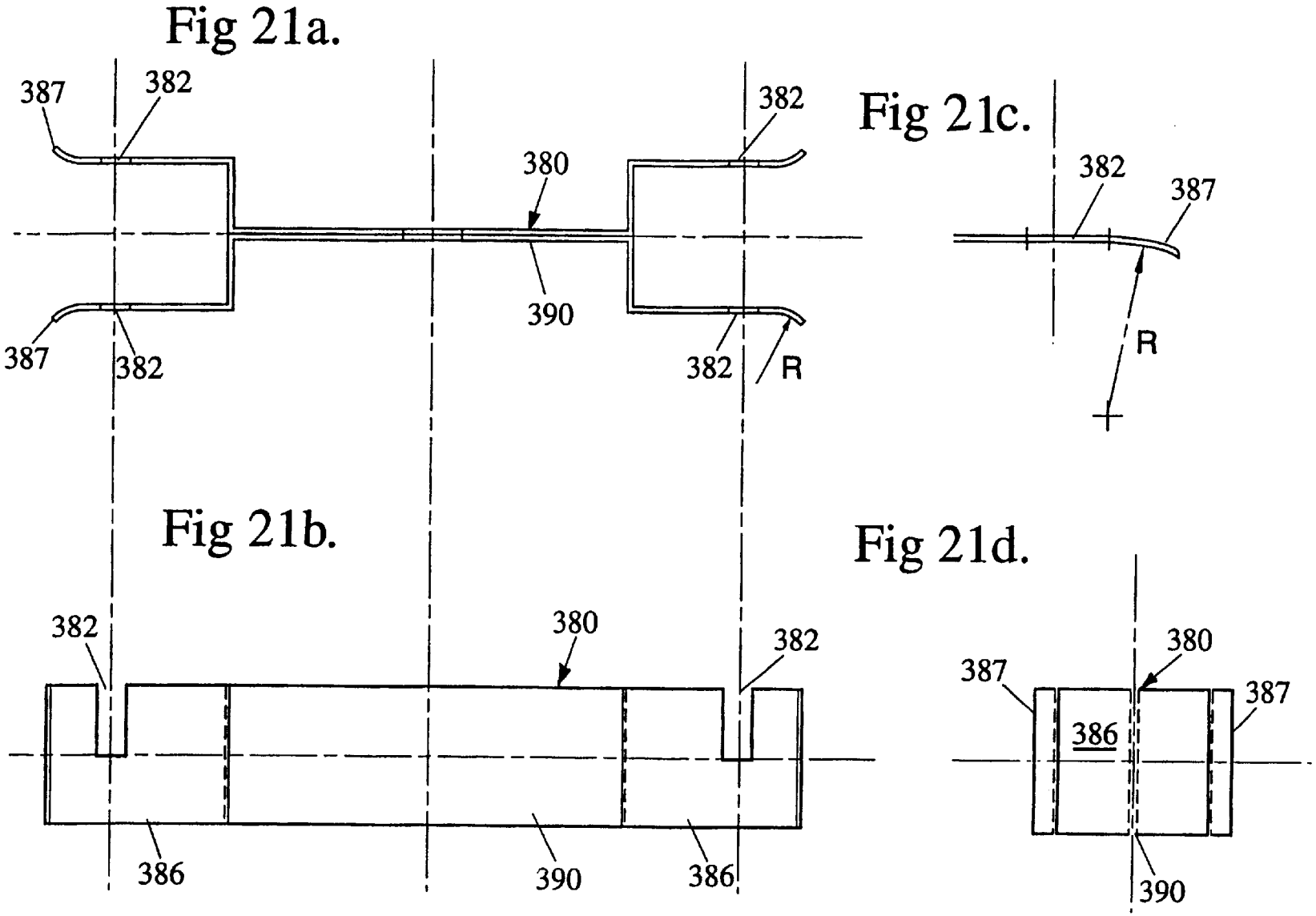
FIG. 21*a* shows a plan view of one example of a connection bracket for connecting single and/or multiple module piers to a wall assembled in accordance with the method of the invention.
FIG. 21*b* shows a front elevation view of connection bracket shown in FIG. 21*a;*
FIG. 21*c* shows a detail of elevation at both ends of connection brackets shown in FIGS. 21*a* and 21*b;*
FIG. 21*d* shows an end elevation view of FIGS. 21*a* and 21*b;*
Figure 22C:
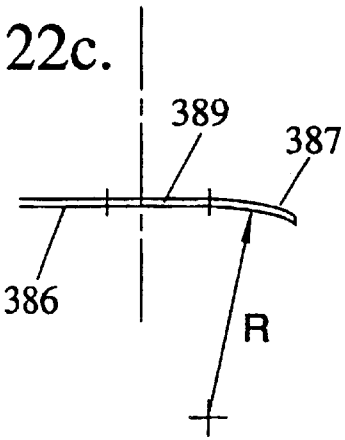
FIG. 22*c* shows a detail of elevation at one end of bracket shown in FIG. 22*a;*
Figure 22D:
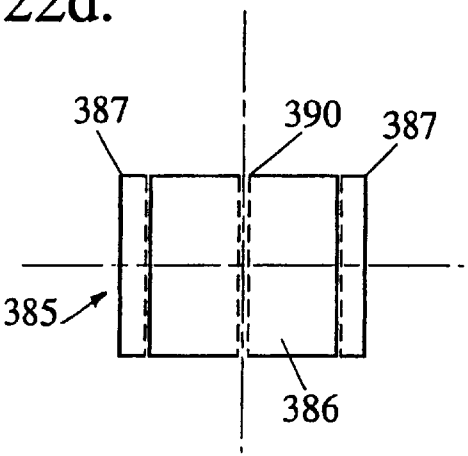
FIG. 22*d* shows an end view of bracket shown in FIGS. 22*a* and 22*b*.
Figure 22A:
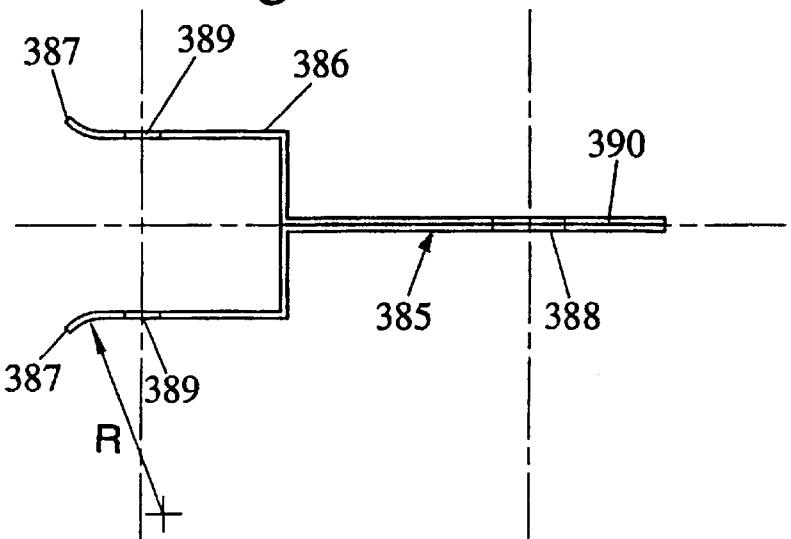
FIG. 22*a* shows a plan view of one example of connection bracket for connecting single module pier to a fence wall assembled in accordance with the method of the invention.
Figure 22B:
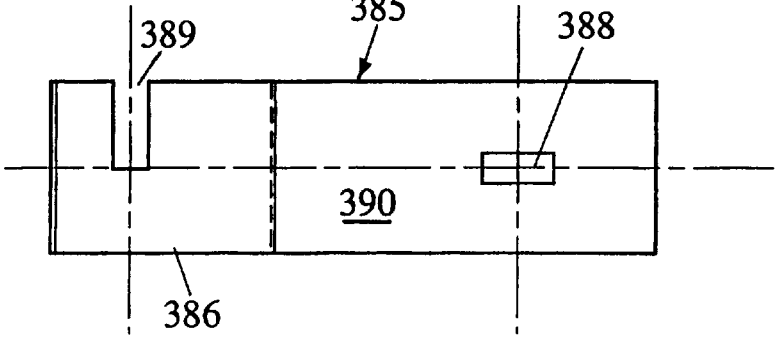
FIG. 22*b* shows a front elevation view of the bracket shown in FIG. 22*a;*

Construction of a piered wall is similar to construction of two separate walls alongside each other and tying both together using the pier bracket 380 of FIG. 21. The number of pier brackets 380 to be used to tie a pier to a wall should not be less than the number of tie rods 350 used to connect an assembly forming a hanger unit 201. That is, where two tie rods 350 are used, two pier brackets 380 are likewise needed at top and bottom to connect the pier 370 to the remainder of wall 340.

The pier bracket 380 comprises two channel sections 386, which form guides for second module webs, connected by a plate or web section 390. The ends 387 of the channel sections 386 are rounded with the walls forming the channel section 386 provided with slotted holes 382.

One method for the construction of a single module pier 370 along a wall 340 constructed with two tie rods is as follows: as the construction of the wall 340 progresses and at the required location of the pier 370 the first tie rod 350 is inserted at the bottom between two standing first modules 310. Wedges 85 are anchored loosely at both ends of the tie rods into the key apertures 372.

Before the wedges 85 are securely driven into the apertures 372 a pier bracket 380 is inserted between first modules 310 with the slotted holes 382 of the bracket 380 facing downward. Spaces 314 left to allow fittings facilitate such insertion. First modules 310 may be moved forward or backward to accommodate this being only loosely connected at this time.

The slotted holes 382 are engaged onto the tie rods 350 and wedged 85 are driven in tightly to anchor the tie rod 350 to the keys 89 at each end ensuring that the pier bracket 380 is fully engaged with the tie rod 350.

The next tie rod 350 is inserted at the top between the webs 312*a* and 312*b* of first modules 310*a* and 310*b*. This tie rod 350 is firmly anchored at each of its ends by fully driving the wedges 85 into key apertures 372 of keys 389.

When the top tie rod 350 has been anchored, another pier bracket 380 is inserted from the top above the tie rod 350 and between the first modules 310*a* and 310*b*. The slotted holes 382 of this pier bracket 380 are likewise pointed downward.

The slotted holes 382 are pressed into engagement with the tie rod 350 at locations on each side of the guides 356.

The first modules 310*a* and 310*b* are connected together following this step to form a supporting structure for second module 320 with pier brackets 380 in position ready for the pier 370 to be constructed.

Two end modules 330 are then stood in the upright position with their flanges 331 back to back against the flanges 311 of first modules 310*a* and 310*b*. Webs 333 of the end modules 330 face each other with the pier bracket 380 symmetrically between them.

Pier tie rod 351, a modified tie rod, is then slid between the webs 333 of end modules 330 and under the pier bracket 380 to engage slotted holes 382 on each side of the guides 386. Pier tie rod 351 is similar to tie rod 50 but has length adapted to the application. Guide rods may be omitted as channel section 386 may form a guide for web 322 of second module 320.

Type E keys 88 are then inserted in each end module 330 to support the pier tie rod 351. Wedges 385 are driven at each end of the pier tie rod 370 through the key apertures to secure the tie rod 351 to the keys 88.

The same procedure is repeated at the top. On completion, two end modules 330 form a supporting structure or hanger unit for second module 320 which is connected to the structure in the manner previously described for wall 40. Such connection should follow full engagement of slots 382 with the wall and pier tie rods 350 and 351 at top and bottom of the wall at the pier location.

A multi-module pier may be constructed by the same method of construction as previously described. In this case, a first module 317 is arranged with flange 317*a* back to back to first module 310*b*. This first module 317 is connected to each end module 330 forming supporting structures for each second module 320, as shown in FIG. 17*a*, in the manner familiar to the invention.

Construction of Columns

Figure 18A:
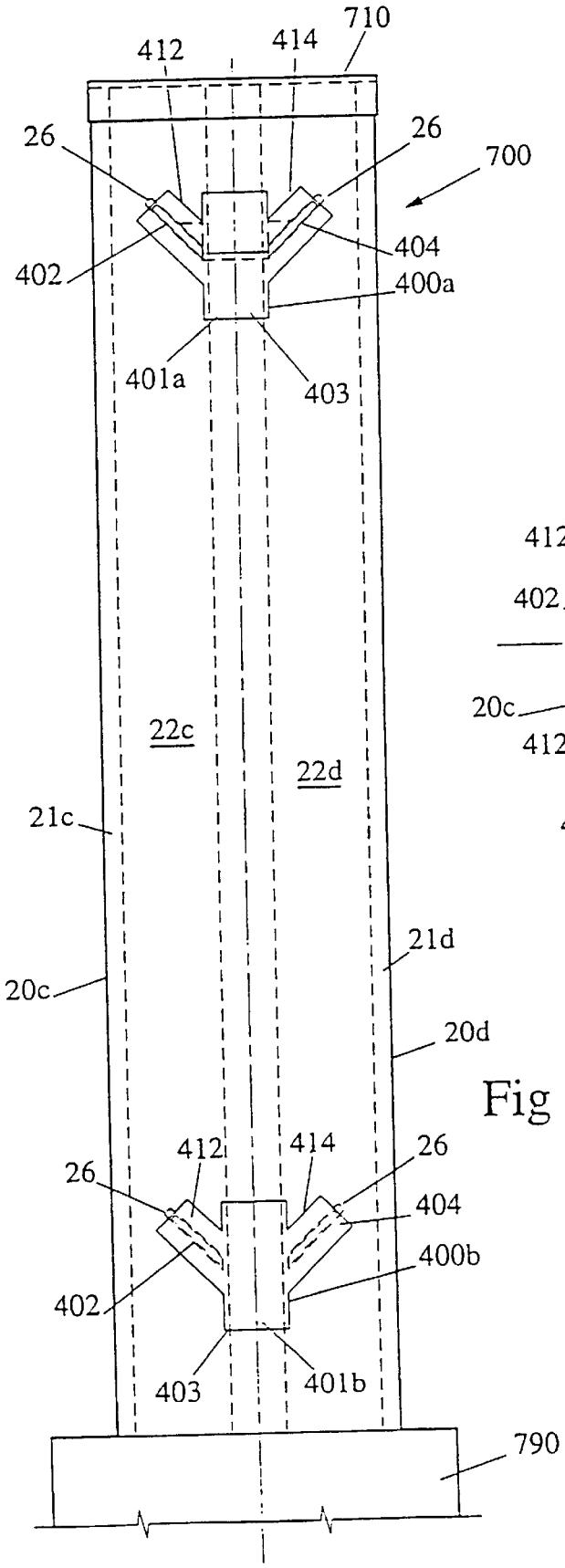
FIG. 18*a* shows a plan view of one example of column assembled in accordance with one embodiment of the invention.
Figure 18B:
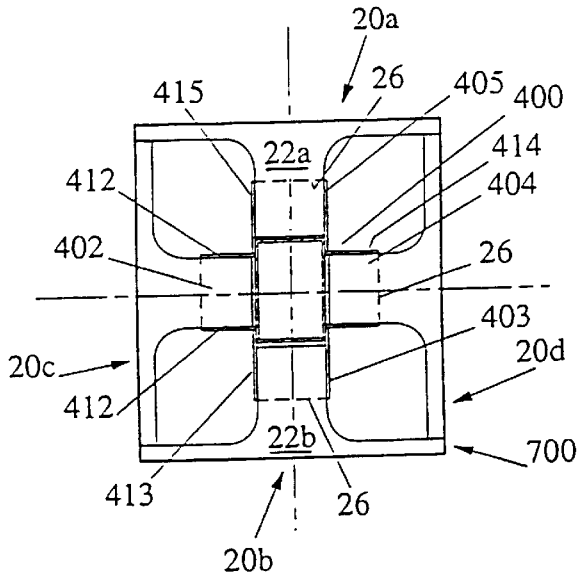
FIG. 18*b* shows an elevation view of FIG. 18*a;*
Figure 23B:
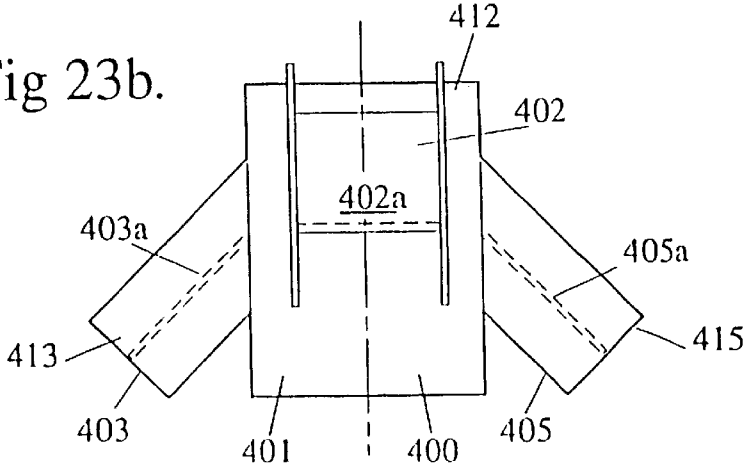
FIG. 23*b* shows a plan view of the connection bracket of FIG. 23*a;*
Figure 23A:
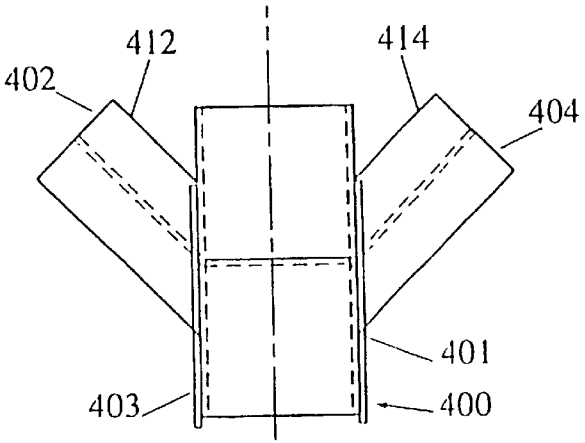
FIG. 23*a* shows a front elevation view of a connection bracket used in construction of a column according to a further embodiment of the invention.
Figure 23C:
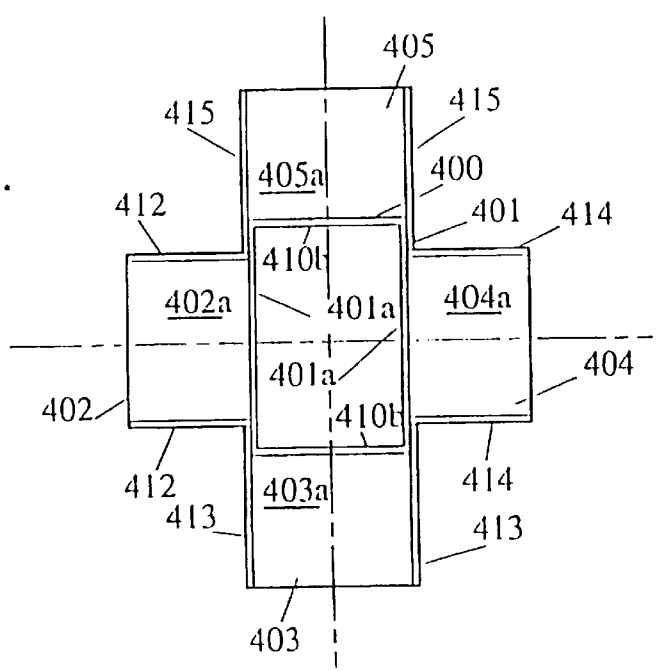
FIG. 23*c* shows a side elevation view of the connection bracket shown in FIGS. 23*a* and 23*b;*
Figure 24A:
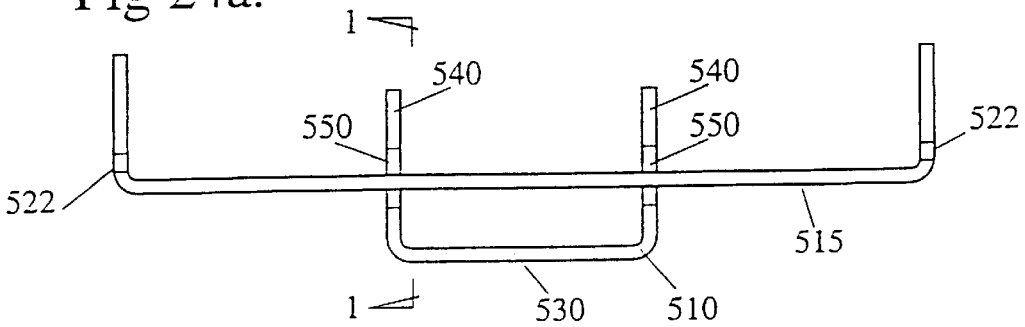
FIGS. 24*a–d* show plan, elevation and side views of one example of a door frame hook bracket assembly for use in accordance with one embodiment of the invention.
Figure 24B:
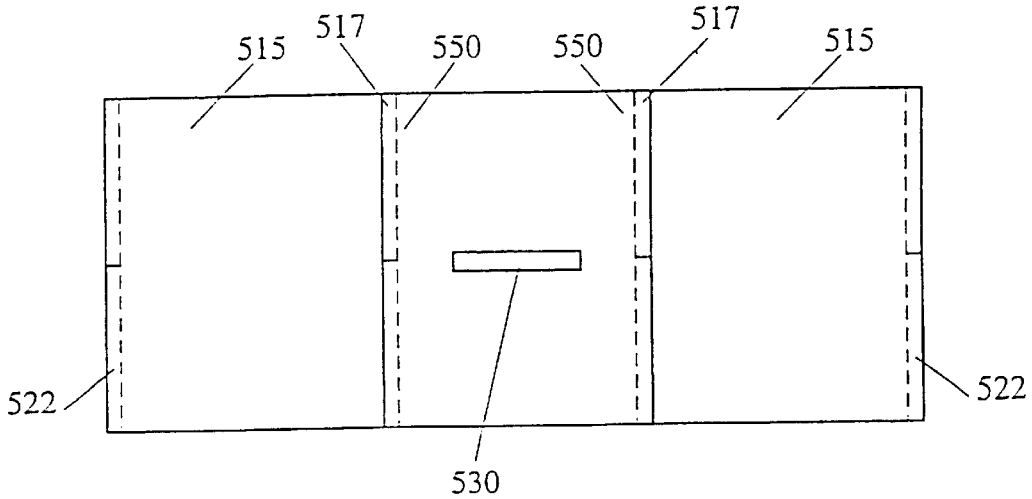
Figure 24C:
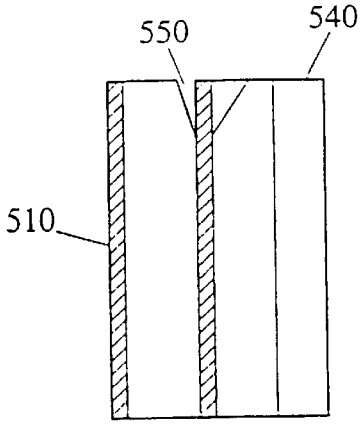
Figure 24D:
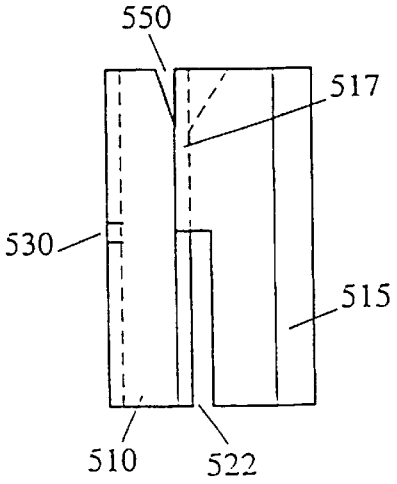
Figure 25A:
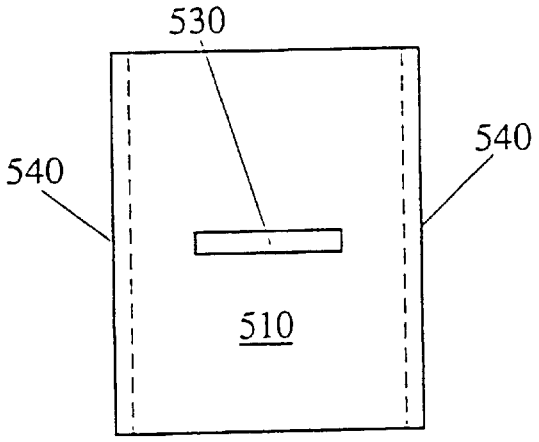
FIGS. 25*a–d* show plan, front, and side elevation views of one example of a first hook bracket for fixing a door frame, a window frame or another wall in accordance with one embodiment of the invention.
Figure 25C:
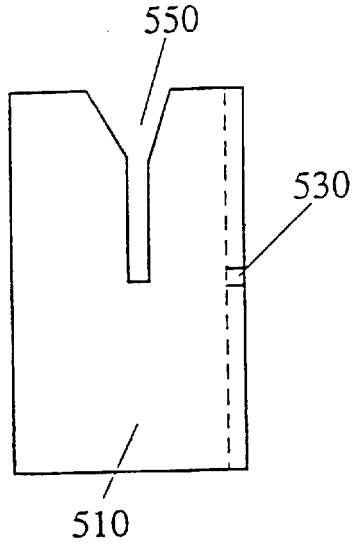
Figure 25D:
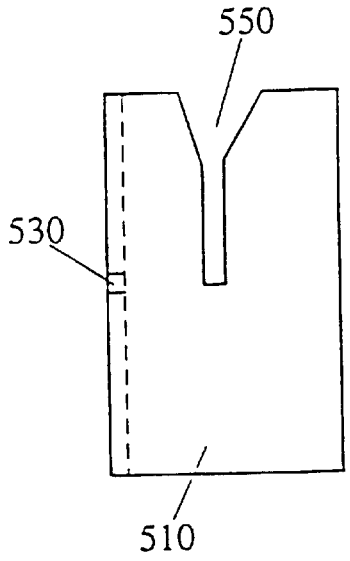
Figure 25B:
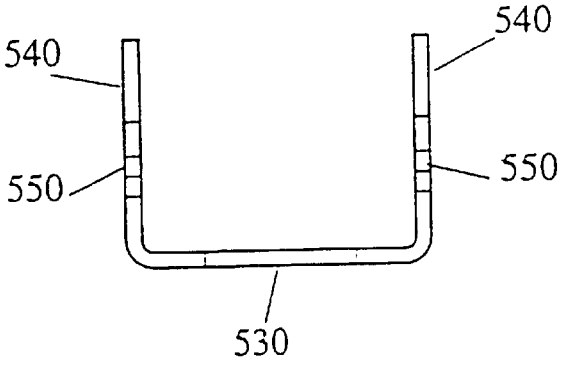
Figure 26A:
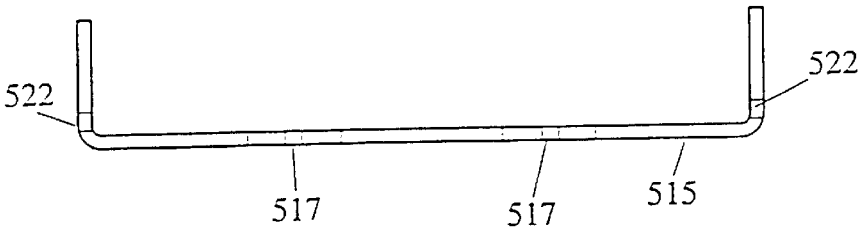
FIGS. 26*a–e* show plan, front and side elevation views; and inverted elevation views of one example of a second hook bracket for fixing a door or window frame in accordance with one embodiment of the invention.
Figure 26C:
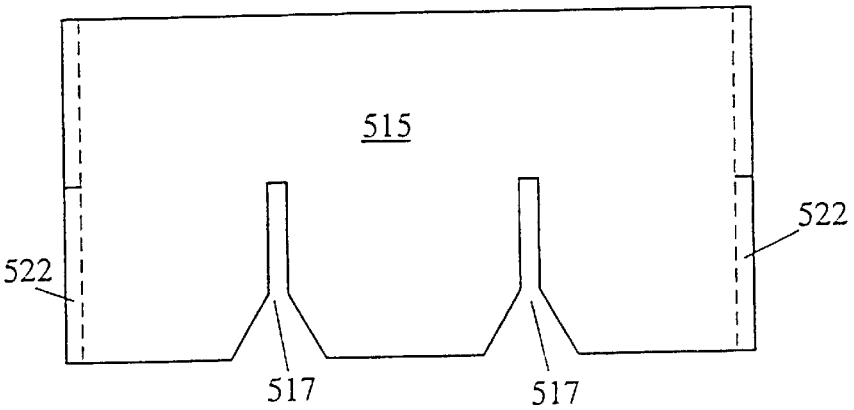
Figure 26E:
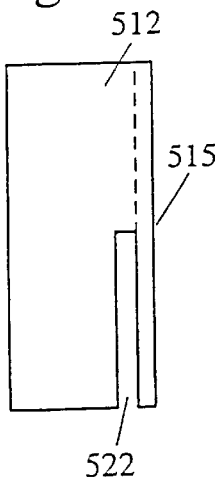
Figure 26D:
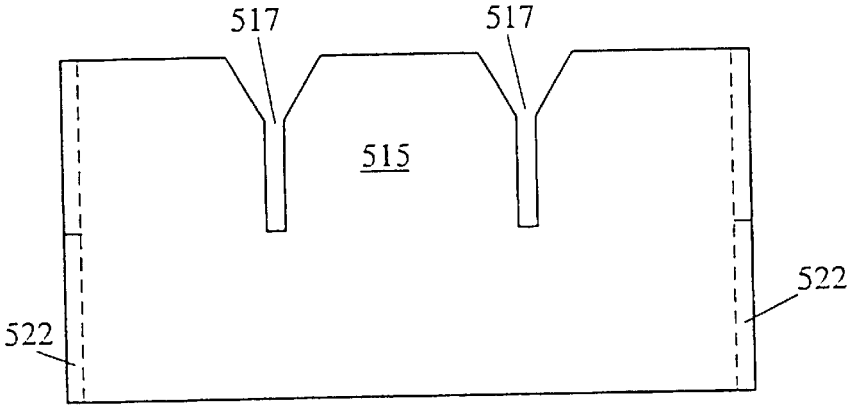
Figure 26B:
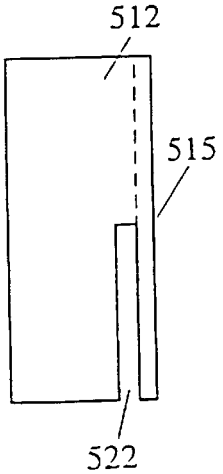

There is now described, referring to FIGS. 18 and 23, the construction of load bearing columns in accordance with a still further embodiment of the present invention.

Column 700 construction involves only second modules 20*a*–20*d*, special connection brackets and, where necessary for bearing heavy loads, structural members. The special connection brackets 400 may be used for light loading on the column of the type encountered in single storey housing projects. For heavy loadings, structural members which may, for example, be of steel or timber of rectangular or other suitable cross-section may be employed.

The bracket 400 is shown in FIG. 23 and is made of a rectangular structural hollow section 401, with four cleats 402, 403, 404, 405 connected to it.

The cleats 402–405 are in the form of plates with upstanding edges 412, 413, 414, 415 in the manner of a box section. The cleats 402–405 are connected at an angle to the horizontal medial axis of the bracket 400 which corresponds to the angle of the bevelled cuts 26 provided in the web 22 of second modules 20. This angle may be, for example, 450.

Two opposed cleats 402 and 404 connected to two opposed sides 401*a* of the rectangular hollow section have angle facing upward. Adjacent these on the remaining opposed sides 401*b* are two opposed cleats 403 and 405 with angle facing downward.

The plate portions 402*a*, 403*a*, 404*a* and 405*a* are designed to engage with the bevelled cuts 26 provided in webs 22 of second modules 20 when assembled into a column.

If a structural member is used to carry heavier loads, the cleats 402–405 are connected directly to it at upper and lower locations but all cleats are angled upward and, conveniently, the structural member is of rectangular hollow section. In this case, cleats 402–405 also correspond with the beveled cuts 26 of second modules 20.

The following description is directed to a column 700 construction for bearing lighter loads.

A suitable footing 790 is formed of concrete or other suitable material. Two second modules 20*a* and 20*b* are stood on the footing 790 with webs 22*a* and 22*b* opposing each other. The bevelled cuts 26 of each module 20*a* and 20*b* face downward so that cleats 403 and 405 of brackets 400*a* and 400*b* may be dropped into them at top and bottom respectively. On completion, there is formed a supporting structure for two remaining second modules 20*c* and 20*d* with walls 413 and 415 assisting in making a secure connection. Modules 20*c* and 20*d* are reversed in relation to modules 20*a* and 20*b* such that their bevelled cuts 26 face upward. These bevelled cuts 26 are brought into engagement with cleats 402 and 404, walls 412 and 414 assisting in making a secure connection, after which connection the column 700 is completed.

A capping member 710 suitable for the column 700 may be fitted at the top.

Assembly of a Door Frame

Description now follows of connection of a door frame 500 to a wall 40 constructed in accordance with a method of the present invention and is made referent to FIGS. 24 to 26, 28 and 29.

The door frame 500, shown in FIG. 28, could be made of metal, timber or any other suitable door frame material of the type used or suitable to be used in the building industry. The most commonly used standard door frames in the building industry are metal and timber door frames.

The metal door frame 500 may be pre-formed or pressed in the factory and advantageously is manufactured complete with architraves, door stops, hinges and latch striker. The width of the door frame 500 is designed to suit the width of the wall 40; or the width of wall 40 making allowance for wall plastering thickness.

At the back faces 580 of both sides of the doorframe 500, that is the faces adjacent to the wall 40, the metal is folded outward away from the architraves, giving each side of the door frame 500 two vertical planes 502 running the full height of the frame 500 and facing the wall 40. This may be conveniently seen in FIGS. 28*b*, 28*d* and 28*e*.

In accordance with a preferred embodiment, the door frame 500 may be connected to end modules 30 defining each side of a door opening by a hook bracket assembly 520 as shown in FIGS. 24 to 26. The top of the door frame 500 is formed such as to allow any shorter first or second modules 10 or 20 above the door frame to sit flat inside the frame with the top architraves restraining these modules from any horizontal movement.

The door frame hook bracket assembly 520 may be of any kind, any shape and size suitable for fitting to end module 30 provided that the door frame sides are such that the door frame 500 can hook and fix to the wall 40 from one side. From the other side of the frame a further end module 30 must connect to the door frame 500. The hook bracket assembly 520 is designed to meet the design strength criteria of the wall 40 being constructed.

In a preferred embodiment of the invention, the hook bracket assembly 50 may be made of flat metal plate of width and thickness to suit the design strength of the wall 40 and doorframe 500 and includes two interlocking brackets: a first bracket 510; and a second bracket 515 as shown in FIG. 24, 25 and 26. The brackets 510 and 515 are designed to suit the type, the size and the profile of the door frame 500 used. For example, a timber door frame could have a second bracket 515 of different shape and fixity than to a steel or aluminium door frame.

The first bracket 510, as shown in FIG. 25, is U-shaped with width designed to fit the width of the longitudinal recess 36 provided in end module 30. The centre of the U-shaped first bracket 500 is provided with a slotted hole 530 to allow fixity to the end module 30 by means of keys and wedges 88 and 85 as earlier described. Other connection means could be employed and end modules 30 could be provided with the first brackets 510 fixed in desired positions.

The legs 540, which may have rounded ends, of the U-shaped first bracket 510 are provided with specially shaped slotted cuts 550 which act as hooks. These slotted cuts 550 cooperate and interlock with similar slotted cuts 517 of the second bracket 515 of the door frame hook bracket assembly 520. It is to be noted that the slotted cuts 517 and 550 are wider at one end than another, this allows location to be made more easily prior to engagement.

FIG. 26 show these slotted cuts 517 located symmetrically about the centre line of second bracket 515. This desirable arrangement is not limiting. Other locations could be used.

Figure 28C:
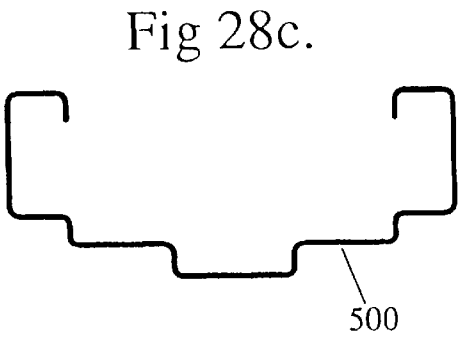
FIG. 28*c* is a section of the door frame along section line A—A of FIG. 28*a;*
Figure 28E:
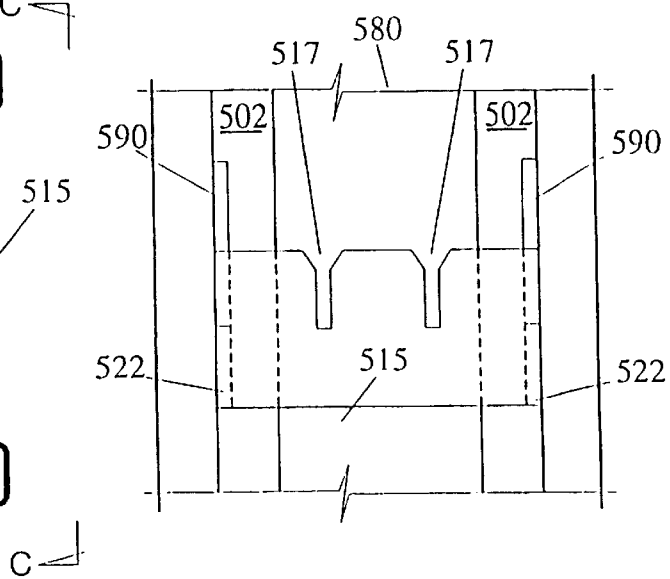
FIG. 28*e* shows a view along section line C—C of FIG. 28*d* showing connection detail of the hook bracket of FIG. 26 to the door frame side of FIG. 28*a;*
Figure 28D:
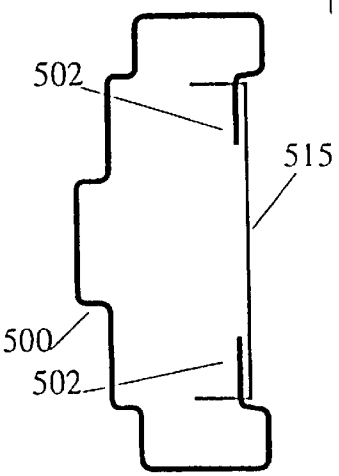
FIG. 28*d* is a section of the door frame along section line B—B of FIG. 28*a;*
Figure 28B:
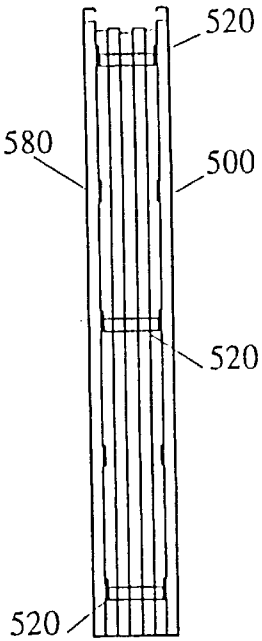
FIG. 28*b* is a side elevation of the door frame of FIG. 17*a;*
Figure 28A:
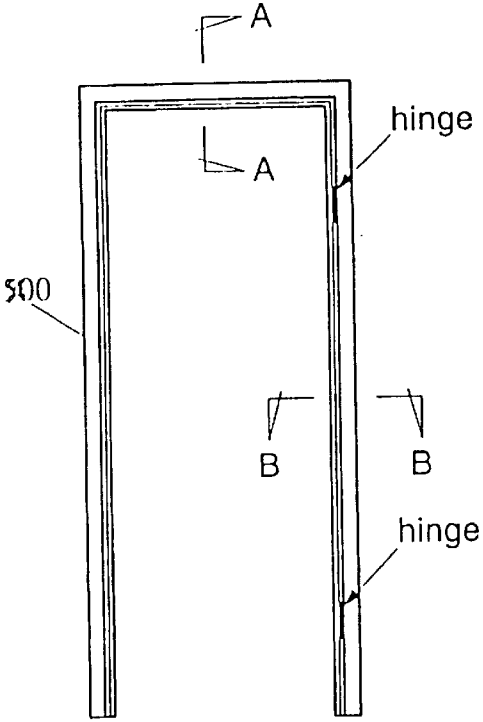
FIG. 28*a* is a front elevation of one example of a door frame for use in accordance with one embodiment of the invention.

Second bracket 515 may be connected to the door frame 500 by suitable keying or securement by cooperation between slots 522 formed in arms 512 of second bracket 515 and rectangular slots 590 formed in the vertical planes 502 running the height of the door frame 500 and facing wall 40 as shown in FIGS. 28*b*, 28*d* and 28*e*. The second bracket 515 could also be fixed to the door frame 500 in the factory or it could be fixed on site during construction.

Alternatively, if the door frame 500 is formed or pressed without the vertical planes 502, the second bracket 515 may be fixed, by welding or otherwise, to each side of the door frame 500 at the designed location(s).

It is preferred that a number, desirably three or four, such hook bracket assemblies 520 are used on each side of the door frame 500 in order to secure it to the wall 40. The location of the first brackets 510 on the end modules 30 must correspond with the locations of second brackets 515 along the side of the door frame 500 so that both, when engaged, can appropriately hook together to make the connection as required.

Construction of the door proceeds as follows:

Step 1. At the door position along the wall 40, three first brackets 510 are fixed to an end module 30 using keys 88 and wedges 85. The legs 540 of first brackets 510 point sideways towards the door opening. The slots 550 provided in the legs 540 of the first bracket 510 face upward.

The number of the hook bracket assemblies 520 required for each side of any door frame 500 depends on the size and the height of the door. One bracket assembly 520 is required at each end of the frame and one at the middle of the frame. Also fixed to the door frame side 503, the side which is to be fixed first to end module 30 of the erected wall, is second bracket 515 having slots 517 facing downward.

Likewise, bracket assemblies 520 are fixed on the other side of the door frame, that to be connected to end module 31. In this case, the assembly is inverted. That is, second bracket 515 is connected to the door frame side 504 with slots 517 facing upward and first bracket 510 is connected to end module 31 so that its slots 550 face downward.

Step 2. The door frame 500 is lifted slightly, so that second bracket 515 on the door frame 500 just clears first bracket 510 on the end module 30. The door frame 500 is then allowed to gently drop vertically until it rests on the floor. This will automatically interlock slots 550 of first bracket 510 with slots 517 of second bracket 515 so that one side of the door frame 500 is locked and securely fixed to the wall 40.

Step 3. A further end module 30 is stood up vertically with the recess 316 of the web 313 facing the free standing door frame side. Three more first brackets 510 are fixed at the corresponding height as the second brackets 515 on the door frame side, but this time with the slotted hook cuts 550 of the first brackets 510 face downward. The slots 517 of second brackets 515 face upward. Each of the brackets 510 and 515 is inverted in direction to that on the other side of the door frame 500.

Step 4. The further end module 30 is lifted and lined symmetrically against the free standing side 504 of the door frame 500. The end module 30 is allowed to gently drop vertically to the floor. This engages and allows the slots 550 of its first brackets 510 to interlock with the slots 517 of the second brackets 515 on the door frame 500 thus securely locking and fixing the end module 30 to the door frame 500. From there on the construction of the wall 40 may proceed in the above described manner. The construction of the shorter modules 10 or 20 which fit above the door may be commenced at any time as the construction of these shorter units is independent of the construction of the remainder of the wall 40.

Assembly of a Window Frame

Figure 19A:
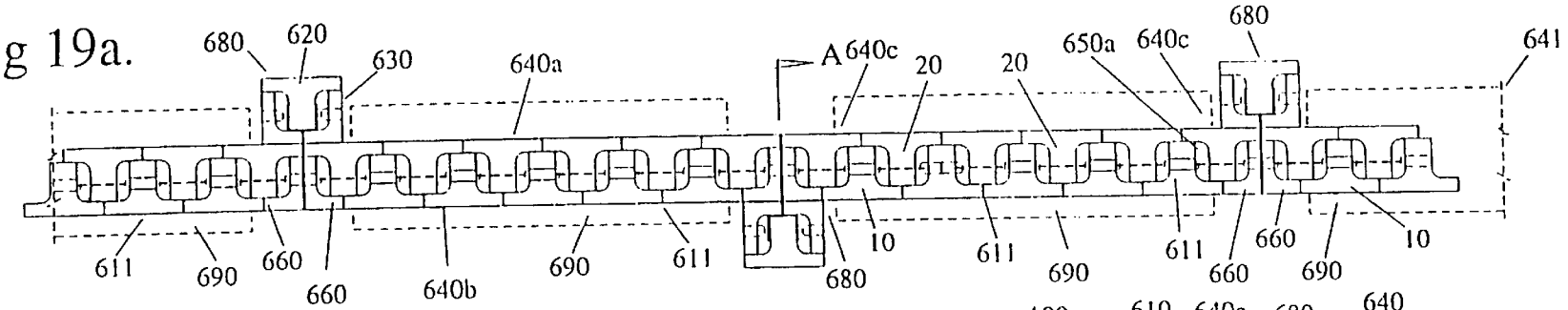
FIG. 19*a* shows a plan view of one example of a fence wall with single module piers, assembled in accordance with one embodiment of the method of the invention.
Figure 19B:
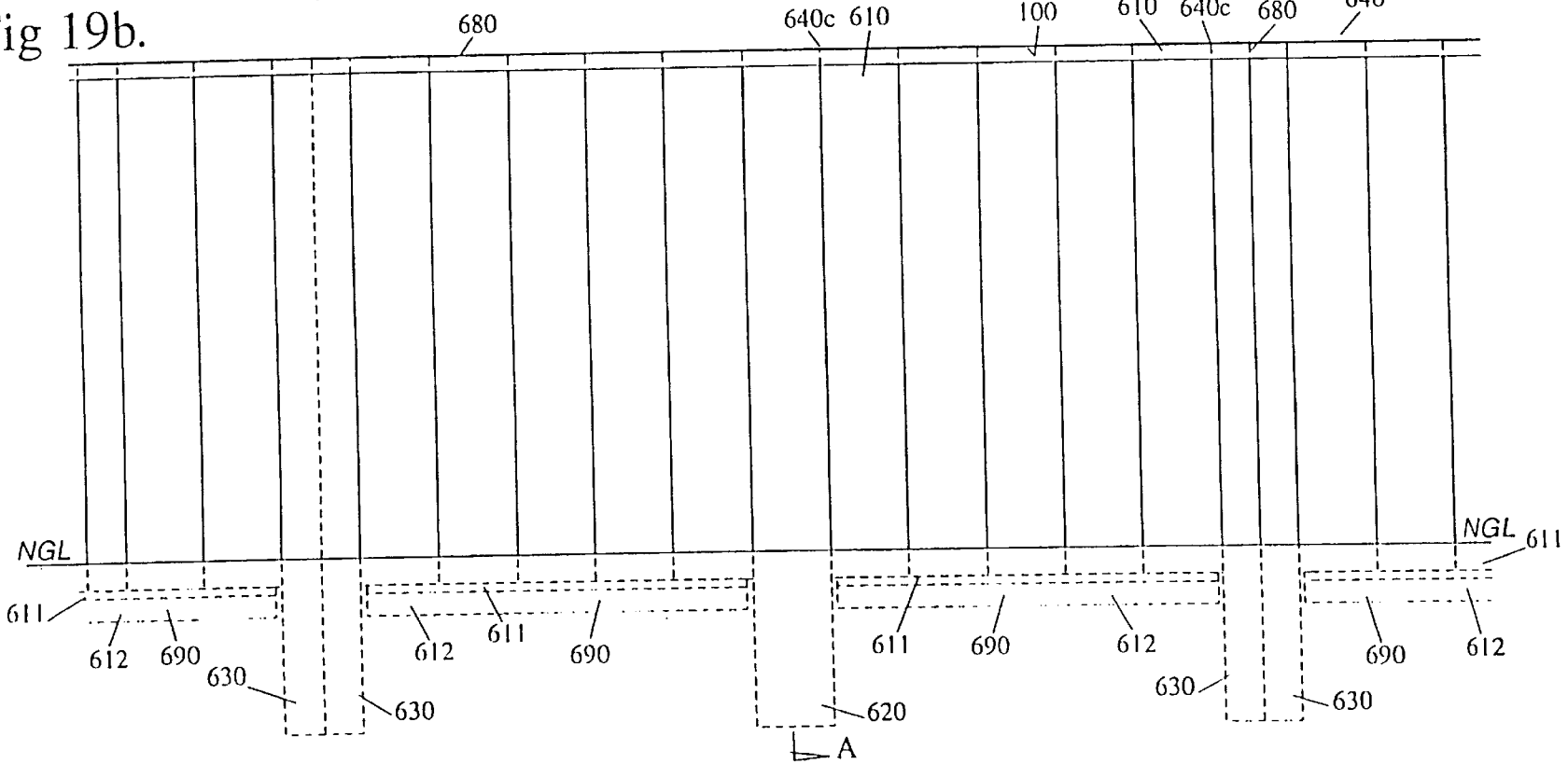
FIG. 19*b* shows an elevation view of the fence wall shown in FIG. 19*a;*

Now follows description of construction of a window in accordance with a preferred embodiment of the invention. A window 800 for use in accordance with the method of the invention includes:

a) a structural window frame part 810, shown in FIG. 19 which is completely independent of the window 800 shown in FIG. 20. This frame part 810 connects and fixes directly to the modules and carries all external vertical and horizontal loads acting on the window 800. Thus, lintels above the windows may be avoided.

b) a window part 820, shown in FIGS. 19 and 20, which has a light metal frame containing the window sashes and the window fly screen. This part fits inside the structural window frame part 810 and is secured in position from the outside by means of a clip-on metal beat 830 which forms part of the external architraves of the window frame.

The window frame 810 could be made from metal such as aluminium, and steel, timber or any other suitable material. It is connected to end modules by hook bracket assemblies similar to the door frame hook bracket assemblies 520 described above the window frame 810 sides are provided with second brackets 515. Alternatively, depending on the material and the cross section profile of the window frames 810, slots 817 may be incorporated into the window frame sides 812 during the manufacturing process. Slots 817 suit slots 550 of first brackets 510. A suitable window frame 810 for the latter will have a hollow rectangular section.

These second brackets 580 or slots 817 allow the window frame 810 to be fixed on one side to the end module 30; and, on inversion, on the other side to end module 31 in the same manner as for the door frame 500 described above. This allows secure fixing of the window frame 810 to the wall 40 being built. The number of hook brackets required per window depends on window size.

Connection of Walls

In analogous manner to connection of door and window frames to the wall, internal walls or partitions may be connected to other walls or partitions of the structure with hook bracket assemblies. Thus a first wall or partition may be connected to a second wall or partition by hook bracket assemblies having cooperating portions connected to the first wall or partition along a line of desired connection and along a vertical length of one end of the second wall. or partition. Two or three such hook bracket assemblies are generally suitable to connect one wall or partition to another.

Figure 27A:
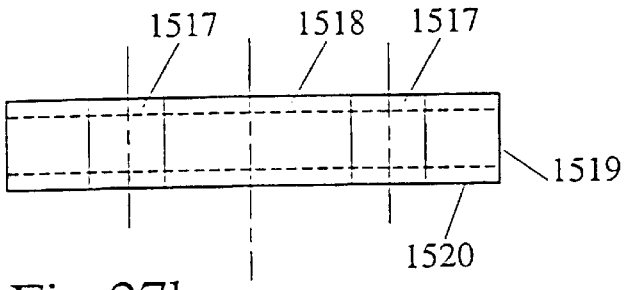
FIG. 27 shows a plan, front and side elevation of a third hook bracket for, in cooperation with the hook bracket of FIG. 25*a–d*, fixing two walls abutting together in accordance with one embodiment of the invention.
Figure 27B:
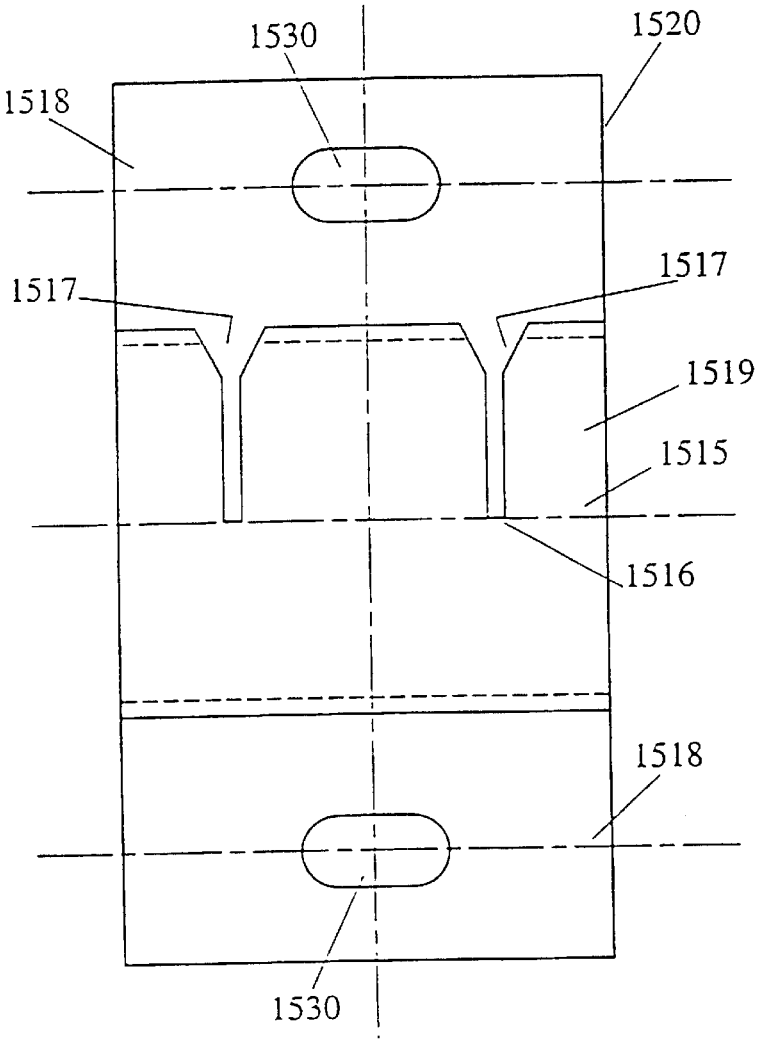
Figure 27C:
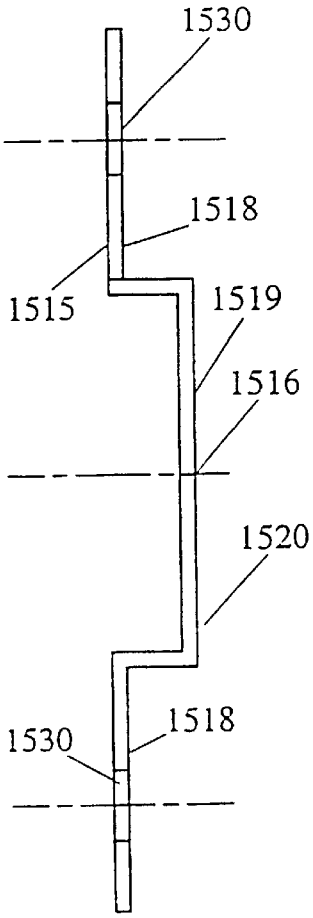

The hook bracket 1520 used, as part of the assembly, is similar in function to second hook bracket 515 described above and is shown in FIG. 27. It comprises a flat plate bent to form a middle U-shaped section 1519 with 25 two flanges 1518. Flanges 1518 are provided with apertures 1530 to accommodate fasteners to secure the hook bracket 1520 to the wall along the line of connection of the wall. Slots 1517 are formed in the U-shaped section 1519 having wider portions at top than at bottom to assist in location prior to securement. They are formed with portions extending back to flange 1518 to accommodate legs 540 of first brackets 510 which extend beyond slots 550 which are accommodated in slots 517 of bracket 1520. The first brackets 510 are connected in corresponding locations to brackets 1520 along the vertical length of the module forming the end of the second wall. Engagement of the slotted cuts 1517, 550 of the first and second brackets connects the first and second walls together in the same manner described above for door frames and window frames.

Construction of a Fence Wall

Fences are designed to resist specified lateral wind loads. This can be achieved either by anchoring them into the ground, by joining them to some means which is anchored to the ground, that is, columns, which can resist lateral loads or by increasing their lateral stability by weight or by the use of piers at certain spacings along the length of the fence wall. In accordance with this aspect of the invention, lateral stability of the fence wall may be achieved by any of the above methods or any combination of them.

As with above described aspects, first, second and end modules are employed to construct a stable solid fence wall. The construction of a standard height fence wall 640(say up to 1.8 m high) involves basically the construction of single module or multi-module piers (as above described referring to FIGS. 17*a* and 17*b*) depending on the wind design loads acting along the length of the fence wall. Such piers 680 could be located on one face 640*a* of the fence wall 640 or on both faces 640*a* and 640*b*, at equal spacings or alternating spacings on each face as shown in FIG. 19*a*.

At each pier center line position along the fence wall 640, the same wall is intersected by a pier bracket 384 connecting the intermediate piers 680 to the face 640*a* of the fence wall 640.

At the location of each intermediate pier 680,the fence wall 640 comprises two end modules 660 arranged back to back between which portion 643 of pier bracket 384 passes. Pier bracket 384 has portions cooperating with pier keys 689 used in connecting end modules 660; and tie rod 351 which is used to connect pier end modules 630. Such cooperation allows positive joining of piers 680 to the wall 640. This is shown in FIG. 19*a* and more clearly in FIG. 20*a*.

Lateral stability of the wall 640 is achieved partly by embedding part of the length of all or some of the piers 680, or alternate piers 680, depending on the height of the fence wall 640, into the natural ground and partly by the mass or weight of the wall 640 and piers 680.

In certain instances, a column of steel, or any other suitable material, can be anchored into the ground by concrete footing along the length of the fence wall 640 at design spacings and the fence wall 640 joins and connects to it. The higher the fence wall 640, the greater the lateral forces acting on it and the more piers are needed to be anchored into the ground to resist these forces.

Standard fence walls generally start and end with piers 688 anchored into the natural ground and have further anchored piers 680 between them.

A suitable footing 690 for the fence wall 640 is a first module 610 laid flat and level between the fence piers 680, in suitably prepared footing trenches. The flange 611 faces upward and the web 612 downward so that it can form a solid hard surface under the modules 610, 620 and 630 forming the wall 640. This can be achieved since forces on the wall due to settlement are practically non-existent.

Starting from one end 641 of the fence wall 640, a trench is dug and prepared in the ground to the lines and levels required. The depth of the trench could be any practical depth provided that the fence wall 640 is allowed an embedment of not less than 100 mm below ground.

The length of the first modules 610 which are designated to be used as footing modules 690 depends on the design spacing between piers 680. It is advantageous to keep their length to a practical minimum bearing in mind the handling and the weight of the modules. The length of a footing module 690 preferably spans the pier to pier spacing. Thus, the vertically standing first module 610 at each end of the wall 640*c* between the piers 680 centrelines, that is the first module 610 which is connected by means of tie rod 650*a* to the end module 660 to form a hanger for second module 620 has maximum support beneath it without interfering with the embedment of the fence pier 680 modules as shown in FIGS. 19*a* and 20*a*.

At a distance at least equal to the width of the pier 680 being constructed from the starting line, the first module 610 designated for the footing 690 is laid at the lines and levels required. Web 612 faces downward. Proper embedment in the natural ground is ensured and the soil around it is compacted. This footing 690 can now act as a gauge from which to measure the depth of embedment of the pier 680 modules specified for the particular height of the wall 640.

The fence wall 640 commences with the single module pier 680 shown in FIG. 20*a* which may be constructed in a manner similar to that described for FIG. 17 but note use of end modules 630*a* and 630*b* which are brought into alignment with webs 633*a* and 633*b* spaced, rather than back to back. These end modules 630*a* and 630*b* are located in a hole prepared for them. A further end module 30 is arranged back to back with end module 630*b*. Keys 88 are inserted into end module 630*a* holes 632*a* facing in the direction of fence wall 640 at top and bottom. Keys 89 facing against the direction of the wall, and having suitable length for the job, are inserted at top and bottom through holes 32 and 632*b*.

Tie rod 651*b* is then inserted at the bottom between the two standing end modules 630*a* and 630*b*. Wedges 85 are anchored loosely at both ends of the tie rod 651 in key apertures 672 such that pier bracket 380 may be inserted between the end modules 630*a* and 630*b* with slotted holes 382 facing downward. Spaces 614 facilitate such insertion which takes place by moving the pier bracket 380 downwardly relative to the extending webs 633*a* and 633*b* into required position. End modules 630*a* and 630*b* may be moved forward or backward to accommodate bracket location being only loosely connected at this time.

Slotted holes 382 of pier bracket 385 are engaged onto the tie rod 651 and wedges 85 are driven in tightly to anchor the tie rod 651 to the keys 88 and 89 such that pier bracket 380 is fully engaged with the tie rod 651.

The operation is repeated at the top and, on completion, construction of a single module pier 680 may be completed as described in respect of FIG. 17 (noting that end modules here form the supporting structure at this portion of the wall rather than first modules). Second modules 20 are connected and these, the modules 630*a*, 630*b* and pier modules 630 are embedded in the ground at a depth specified by the designer, say 600mm below natural ground level (NGL).

From end module 30, construction of wall 640 continues in the manner above described up to the next pier location where an end module 660 is used to terminate the wall segment 695.

A further end module 660 is then arranged back to back with end module 660, again located in a hole corresponding with the location of the intermediate pier 685, and pier keys 689 are inserted, at top and bottom (designated by "a" and "b" respectively in the drawings), between the two modules 660 with pier brackets 384 connected to the pier keys 689. Pier bracket 384 is shown in FIG. 22, and is similar to bracket 380 with the exception that it has a channel section 386 only at one end for a single-sided pier; it would have two channel sections 386 for a double sided pier. Keys 689 extend through apertures 662 in end modules 660 (recesses omitted); and also through slot 388 in plate section 390 of pier bracket 384 making connection between pier brackets 384 and keys 689.

Channel section 386 has width greater than the distance between pier tie rod 685 guides (if any are provided) and its ends 387 are rounded. It is provided with slots 389 on each side of the channel section 386 to engage with the tie rod 351 connecting the end modules forming the supporting structure for second module 620 which completes the pier. This tie rod 351 is shorter in length than tie rod 50. Thus, this pier bracket 384 is positioned, with slots 389 facing upward, prior to construction of the pier 680, which occurs in the manner previously described. Embedment completes the job.

The construction of wall 640 and piers 680 from that point is as above described, for construction of a pier 370, except that the tie rod 351 will be brought into engagement with slots 382 of pier bracket 385 from above and not below.

Construction of the fence wall 640 can be advantageously achieved when working from one end of the wall 640 to the other constructing the wall 640 and pier 680 together as the construction progresses rather than building the wall first and the piers after.

Suitable capping 100 or 180 may be employed during construction or after the fence wall 640 is complete. Corners may be formed in a fence wall in the manner as above described.

Modifications and Variations

Modifications and variations may be made to the invention as described herein by those skilled in the art. Such modifications and variations are within the scope of the present invention. For example, even though the modules are described as having a plain concrete panel portion, this portion could be fabricated as desired without modification of the invention. For example, different shaped or different coloured modules could be employed is accordance with the invention.

In yet another form of the invention the small rectangular holes 13, 32 in the webs of first and end modules 10 and 30 and the large angled slotted cuts 26, 27 in the web 22 of second module 20 could be replaced by brackets or mouldings of any suitable material such as steel, aluminium, etc. These brackets or mouldings could be cast into or surface mounted and fixed to the sides of the web or to the flange of the section and the connection means could be modified to suit them with or without the use of the keys and wedges which are part of the connection means. The necessary positive vertical, longitudinal and horizontal anchorage to the modified connection means connecting the modules together is still to be achieved. Moreover, the same brackets or mouldings could run the full length of the module(s) or could be of shorter lengths located at designated locations along the length of the web of the module(s).

Further, the tie rod could be modified at its ends to suit the connection means provided for connection of first and end, end and end or first and first modules.

The claims defining the invention are as follows:

1. A method of construction of a wall from first, second and end modules each having a portion forming one part of the face of the wall including:

aligning a first or end module and one of: a first and an end module in a desired alignment;

connecting the two modules together with at least one first connection means, having a tie portion generally extending in the direction of alignment, to form a supporting structure for at least one second module; and connecting a second module having a T-section with a flange portion and a vertically extending web portion to the supporting structure by cooperation of a slotted connection portion of said second module, with a corresponding rod which forms the tie portion of said supporting structure, to form at least a portion of the wall, wherein the portion of the wall is held in tension.

2. The method of claim 1, wherein adjoining first, end or first and end modules are connected together by a plurality of first connection means spaced along vertical lengths of the adjoining modules providing a plurality of corresponding tie portions for engaging cooperation with plural slotted connection portions of the second module allowing connection to the supporting structure.

3. The method of claim 1, wherein said first connection means includes guide means for locating said second modules in desired spaced relation to the supporting structure.

4. The method of claim 3 wherein said guide means form part of said tie portion and said corresponding tie portion has length substantially equal width of said second module web.

5. The method of claim 1, wherein the second module has two beveled slots which, during construction, engage with rods forming two corresponding tie portions of said first connection means for connection of second modules to the supporting structure.

6. The method of claim 1, wherein during and on connection of second modules to the supporting structure, the vertically extending web portion extends between a guide means.

7. The method claim 1, wherein the wall comprises an L-section end module defining an end to a wall, said end module being connected to a further first module by the first connection means.

8. The method of claim 1 wherein the end module is provided with a second connection means for connection to one side of a door frame or window frame.

9. The method of claim 8 wherein said door or window frame includes, on another side, second connection means for connection to a further end module.

10. The method of claim 8 wherein said second connection means is hook bracket assemblies.

11. The method of claim 10, herein the hook bracket assemblies connect the other side of the frame to the further end module.

12. The method of claim 1 wherein a first wall is connected to a second wall by hook bracket assemblies having first cooperating portions connected to the first wall along a line of desired connection; and second cooperating portions connected along a vertical length of one end of the second wall such that on cooperation, connection is made.

13. The method of claim 1 wherein, at a corner, first modules are aligned at the angle of the comer and connected together by a third connection means including a key or tie portion angled at the angle of the comer to form a supporting structure for second modules to complete the comer.

14. The method of claim 1 wherein, at a corner, modules of adjoining supporting structures are aligned at the angle of the comer and connected together by a third connection means including key or tie portions shaped to suit the corner.

15. The method of claim 1 wherein a capping member is used at the top or bottom of a portion of the wall for further connection of modules comprising the wall portion and distribution of horizontal and vertical forces along the wall.

16. The method of claim 15 wherein said capping member is a castellated member provided with cleats for connection to structural members supported on top of the wall.

17. The method of claim 1 wherein said wall has at least one pier along its length including at least two end modules or a first and an end module being pier modules connected together by first connection means to form a supporting structure for a second module of the pier wherein said supporting structure is connected to the remainder of the wall by a bracket having first means for engaging first connection means connecting two modules forming part of the remainder of the wall together; and second means for engaging said first connection means connecting said at least two pier modules together such that on engagement of said first and second engagement means with said first connection means said pier is connected to said remainder of said wall.

18. A structure including a wall constructed in accordance with claim 1.

19. A structure as claimed in claim 18 being a fence.

20. A kit for use in construction of a wall, comprising first, second and end modules; wherein the second modules have a T-section with a flange portion and a vertically extending web portion provided with a slotted connection portion, door frames, window frames, capping members and first, second, and third connection means.

21. A wall, comprising first, second, and end modules, and a connection means for tying adjoining modules together in tension, wherein the connection means for tying adjoining modules together comprises a tie rod with longitudinally spaced lugs having apertures for accommodating a wedge for anchoring said connection means to a key.

22. The wall of claim 21, wherein the first module comprises a web and a flange forming part of a face of the wall, wherein said web is formed with rectangular holes for accommodating the connection means connecting the module with a further module to form a supporting structure for second modules.

23. The wall of claim 21, wherein the end module comprises a web and a flange, wherein said web is provided with a recess having rectangular holes for accommodating key means for connection of said end module to a further module forming a support structure for second modules.

24. The wall of claim 21, wherein the connection means for tying adjoining modules together further comprises a guide means spaced along said tie rod for locating a web of the second module having a flange forming part of a face of the wall.

25. The wall of claim 21 wherein said key is a metal plate formed with at least one aperture to engage with the wedge for anchoring the connection means to said key for tying at least two modules together.

26. The wall of claim 21, wherein said wedge engages with an aperture of the key for anchoring said connection means to said key in tying at least two modules together.

27. The wall of claim 23, further comprising a hook bracket assembly.

28. The wall of claim 21, wherein the second module comprises a web and a flange forming part of a face of the wall, wherein angled slots are formed in said web proximate ends of the module for engagement with corresponding tie portions of the first connection means connecting together modules of a supporting structure.

29. A method of constructing a structural column comprising:

(a) assembling of modules having a flange and a web with connection portions being angled slots formed proximate the ends of said module webs wherein webs of two modules are aligned with slots facing downwards;

(b) inserting cleats of a connection means facing downwards into the slots at top and bottom of the webs to form a supporting structure comprised of said modules and a connection bracket; and (c) engaging angled slots of two further modules facing upward with upward facing cleats of said connection means at top and bottom of said further modules to form the column, wherein the column is held in tension.

30. The method of claim 29, wherein said connection means comprises a bracket having a body of rectangular section, two opposed sides of said section connecting to cleats angling upward from a horizontal medial axis of said section and the remaining two opposed sides of said section connecting to cleats angled downward from said horizontal axis, said cleats engaging with said angled slots of said modules to form the column.

31. The method of claim 30, wherein said connection means is a structural member extending substantially the length of said column wherein said column is formed with cleats facing upward to engage with angled slot connection portions of said modules; and wherein said column is connected to a footing.

32. The method of claim 29, wherein the connection bracket comprises a body of rectangular section, wherein two opposed sides of said body are connected to cleats angling upward from a horizontal medial axis and the remaining two opposed sides of said body are connected to cleats angling downward from said horizontal medial axis, the cleats comprising plate portions for engaging angled slots of modules having a flange and a web, and formed in the web and upstanding walls defining two edges of said plate portions and provided to make engagement secure.

33. A wall, comprising first, second, and end modules, and a connection means for tying adjoining modules together in tension, wherein the second module comprises a web and a flange forming part of a face of the wall, wherein angled slots are formed in said web proximate ends of the module for engagement with corresponding tie portions of the connection means connecting together modules of a supporting structure.

* * * * *